US010487289B2

(12) United States Patent
Burns, III et al.

(10) Patent No.: US 10,487,289 B2
(45) Date of Patent: Nov. 26, 2019

(54) LUBRICATING OIL COMPOSITIONS AND METHODS OF USE THEREOF

(71) Applicant: ExxonMobil Research and Engineering Company, Annandale, NJ (US)

(72) Inventors: Raymond G. Burns, III, Aston, PA (US); Smruti A. Dance, Robbinsville, NJ (US); Douglas E. Deckman, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 15/880,946

(22) Filed: Jan. 26, 2018

(65) Prior Publication Data

US 2018/0237722 A1 Aug. 23, 2018

Related U.S. Application Data

(60) Provisional application No. 62/461,428, filed on Feb. 21, 2017.

(51) Int. Cl.

| | |
|---|---|
| ***C10M 161/00*** | (2006.01) |
| ***C10M 139/00*** | (2006.01) |
| ***C10M 133/12*** | (2006.01) |
| ***C10M 129/10*** | (2006.01) |
| ***C10M 129/70*** | (2006.01) |
| ***C10M 149/10*** | (2006.01) |

(Continued)

(52) U.S. Cl.

CPC ..... *C10M 161/00* (2013.01); *C10M 101/00* (2013.01); *C10M 129/10* (2013.01);

(Continued)

(58) Field of Classification Search

CPC ..... C10M 2217/028; C10M 2203/003; C10M 2227/06; C10M 2215/26; C10M 2207/024;

(Continued)

(56) References Cited

U.S. PATENT DOCUMENTS 1,815,022 A 7/1931 Davis
2,015,748 A 10/1935 Frolich (Continued)

FOREIGN PATENT DOCUMENTS

CA 1094044 A 1/1981
EP 0471071 B1 9/1991

(Continued)

OTHER PUBLICATIONS

Shahid, Ejaz M. et al., "A review of biodiesel as vehicular fuel", Renewable and Sustainable Energy Reviews, 2008, vol. 12, pp. 2484-2494.

(Continued)

*Primary Examiner* — Vishal V Vasisth

(74) *Attorney, Agent, or Firm* — Robert A. Migliorini

(57) ABSTRACT

A method for improving oxidation stability and viscosity control, while maintaining or improving cleanliness performance and deposit control, in an engine or other mechanical component lubricated with a lubricating oil by using as the lubricating oil a formulated oil. The formulated oil has a composition including a lubricating oil base stock as a major component, and a mixture of (i) at least one detergent, and (ii) at least one antioxidant, or a mixture of (i) at least one detergent, (ii) at least one dispersant, and (iii) at least one antioxidant, as minor components. The at least one detergent comprises a sulfonate detergent, the at least one dispersant comprises a borated dispersant, and the at least one antioxidant includes an alkylated diphenylamine. The engine or other mechanical component is lubricated with the lubricating oil operating in the presence of biodiesel fuel. A lubricating oil formulated with the above major and minor components.

8 Claims, 10 Drawing Sheets

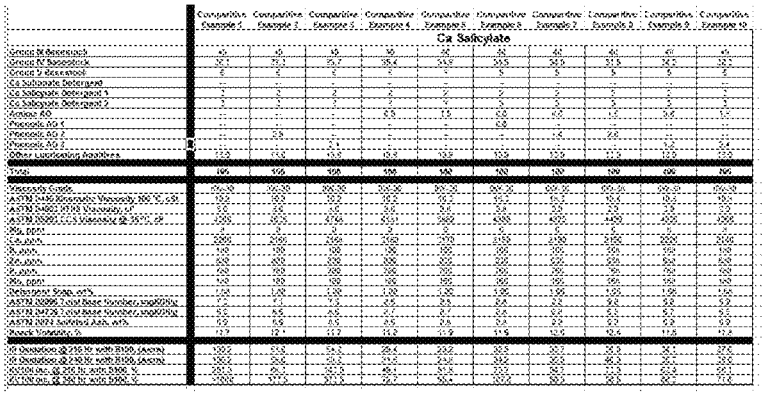

(51) Int. Cl.

| | |
|---|---|
| ***C10M 155/00*** | (2006.01) |
| ***C10M 169/04*** | (2006.01) |
| ***C10M 101/00*** | (2006.01) |
| ***C10M 163/00*** | (2006.01) |

(52) U.S. Cl.

CPC ..... *C10M 129/70* (2013.01); *C10M 133/12* (2013.01); *C10M 139/00* (2013.01); *C10M 149/10* (2013.01); *C10M 155/00* (2013.01); *C10M 163/00* (2013.01); *C10M 169/044* (2013.01); *C10M 2203/003* (2013.01); *C10M 2203/1025* (2013.01); *C10M 2205/0285* (2013.01); *C10M 2207/024* (2013.01); *C10M 2207/026* (2013.01); *C10M 2207/262* (2013.01); *C10M 2207/281* (2013.01); *C10M 2207/289* (2013.01); *C10M 2215/064* (2013.01); *C10M 2215/26* (2013.01); *C10M 2215/28* (2013.01); *C10M 2217/028* (2013.01); *C10M 2219/046* (2013.01); *C10M 2223/045* (2013.01); *C10M 2227/06* (2013.01); *C10M 2229/00* (2013.01); *C10N 2210/02* (2013.01); *C10N 2210/06* (2013.01); *C10N 2230/02* (2013.01); *C10N 2230/04* (2013.01); *C10N 2230/10* (2013.01); *C10N 2230/12* (2013.01); *C10N 2240/102* (2013.01); *C10N 2240/103* (2013.01); *C10N 2260/14* (2013.01)

(58) Field of Classification Search

CPC ..... C10M 2207/281; C10M 2229/00; C10N 2230/04; C10N 2230/10; C10N 2230/02; C10N 2240/102; C10N 2240/103

See application file for complete search history.

(56) References Cited

U.S. PATENT DOCUMENTS

| | | | |
|---|---|---|---|
| 2,100,993 | A | 11/1937 | Bruson |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Koome et al. |
| 3,036,003 | A | 5/1962 | Verdol |
| 3,087,936 | A | 4/1963 | Le Suer |
| 3,172,892 | A | 3/1965 | Le Suer et al. |
| 3,200,107 | A | 4/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,594,172 | A | 6/1986 | Sie |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,910,355 | A | 3/1990 | Shubkin et al. |
| 4,921,594 | A | 5/1990 | Miller |
| 4,943,672 | A | 7/1990 | Hamner et al. |
| 4,952,739 | A | 8/1990 | Chen |
| 4,956,122 | A | 9/1990 | Watts et al. |
| 4,975,177 | A | 12/1990 | Garwood et al. |
| 5,068,487 | A | 11/1991 | Theriot |
| 5,084,197 | A | 1/1992 | Galic et al. |
| 5,430,105 | A | 7/1995 | Redpath et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 6,323,164 | B1 | 11/2001 | Liesen et al. |
| 7,704,930 | B2 | 4/2010 | Deckman et al. |
| 7,838,474 | B2 | 11/2010 | Boffa |
| 7,960,322 | B2 | 6/2011 | Boffa |
| 8,048,833 | B2 | 11/2011 | Habeeb et al. |
| 8,349,775 | B2 | 1/2013 | Teshima et al. |
| 8,367,593 | B2 | 2/2013 | Varadaraj et al. |
| 8,377,856 | B2 | 2/2013 | Devlin et al. |
| 8,680,029 | B2 | 5/2014 | Habeeb et al. |
| 9,090,849 | B2 | 7/2015 | Adamczewska et al. |
| 2006/0223724 | A1 | 10/2006 | Gatto et al. |
| 2008/0020950 | A1 | 1/2008 | Gray et al. |
| 2009/0111720 | A1* | 4/2009 | Boffa ..... C10M 133/12 508/371 |
| 2010/0249000 | A1 | 9/2010 | Kamano |
| 2010/0292112 | A1 | 11/2010 | Devlin et al. |
| 2011/0030269 | A1 | 2/2011 | Chasan et al. |
| 2013/0102509 | A1 | 4/2013 | Shinoda et al. |
| 2015/0307803 | A1 | 10/2015 | Zhang |
| 2015/0322368 | A1 | 11/2015 | Patel et al. |
| 2016/0326453 | A1* | 11/2016 | Galic Raguz ..... C10M 163/00 |
| 2017/0198233 | A1 | 7/2017 | Zhang et al. |
| 2017/0267941 | A1 | 9/2017 | Zhang |

FOREIGN PATENT DOCUMENTS

| | | | |
|---|---|---|---|
| EP | 0464546 | A1 | 1/1992 |
| EP | 0464547 | A1 | 1/1992 |
| EP | 2290038 | A2 | 3/2011 |
| EP | 2290038 | B1 | 3/2012 |
| GB | 1350257 | A | 4/1974 |

(56) References Cited

FOREIGN PATENT DOCUMENTS

| | | | |
|---|---|---|---|
| GB | 1390359 | A | 4/1975 |
| GB | 1429494 | A | 3/1976 |
| GB | 1440230 | A | 6/1976 |
| WO | 2011/095549 | A2 | 8/2011 |

OTHER PUBLICATIONS

Schmiedel, H.-P., "Biofuels—Properties and experiences with their use—Update Biokraftstoffe—Eigenschaften und erfahrungen bei der anwendun—Fortschreibung", DGMK Forschungsbericht, 2005, vol. 611, issue 1, p. 51, Abstract.

Teshima, K. et al., "Developments of an engine oil for biodiesel fuel", 14 Annual Fuels and Lubes Asia Conference, 2008, p. 36, Abstract.

Jiang, Wu et al., Effect of Biodiesel on Oxidation Stability, Detergency and Antiwear Ability of Diesel Oil, 2011, vol. 13, issue 4, pp. 58-63.

Panesar, A., "Fuels testing and effect of additives", 14th Annual Fuels and Lubes Asia Conference, 2008, Abstract.

Ng, E. et al., "Handling the impact of biodiesel fuel on lubricants", Annual Fuels and Lubes Asia Conference and Exhibition, 2011, p. 31, Abstract.

Gili, F. et al., "The impact of biofuels on engine oil performance", Lubrication Science, 2011, vol. 23, pp. 313-330.

Sem, Thomas, "Effect of Various Lubricating Oils on Piston Deposits in Biodiesel Fueled Engines", SAE World Congress, 2004, Detroit, Michigan.

The International Search Report and Written Opinion of PCT/US2018/015425 dated Mar. 28, 2018.

* cited by examiner

Fig. 1

| | Comparitive Example 1 | Comparitive Example 2 | Comparitive Example 3 | Comparitive Example 4 | Comparitive Example 5 | Comparitive Example 6 | Comparitive Example 7 | Comparitive Example 8 | Comparitive Example 9 | Comparitive Example 10 |
|---|---|---|---|---|---|---|---|---|---|---|
| | Ca Salicylate | | | | | | | | | |
| Group III Basestock | 40 | 40 | 40 | 40 | 40 | 40 | 40 | 40 | 40 | 40 |
| Group IV Basestock | 36.1 | 33.3 | 33.7 | 35.4 | 34.6 | 34.6 | 34.0 | 31.8 | 34.2 | 32.2 |
| Group V Basestock | 5 | 5 | 5 | 5 | 5 | 5 | 5 | 5 | 5 | 5 |
| Ca Sulfonate Detergent | -- | -- | -- | -- | -- | -- | -- | -- | -- | -- |
| Ca Salicylate Detergent 1 | 2 | 2 | 2 | 2 | 2 | 2 | 2 | 2 | 2 | 2 |
| Ca Salicylate Detergent 2 | 3 | 3 | 3 | 3 | 3 | 3 | 3 | 3 | 3 | 3 |
| Amine AO | -- | -- | -- | 0.8 | 1.5 | 0.8 | 0.8 | 1.5 | 0.8 | 1.5 |
| Phenolic AO 1 | -- | -- | -- | -- | -- | 0.8 | -- | -- | -- | -- |
| Phenolic AO 2 | -- | 2.8 | -- | -- | -- | -- | 1.4 | 2.8 | -- | -- |
| Phenolic AO 3 | -- | -- | 3.4 | -- | -- | -- | -- | -- | 1.2 | 2.4 |
| Other Lubricating Additives | 13.9 | 13.9 | 13.9 | 13.9 | 13.9 | 13.9 | 13.9 | 13.9 | 13.9 | 13.9 |
| Total | 100 | 100 | 100 | 100 | 100 | 100 | 100 | 100 | 100 | 100 |
| Viscosity Grade | 0W-30 | 0W-30 | 0W-30 | 0W-30 | 0W-30 | 0W-30 | 0W-30 | 0W-30 | 0W-30 | 0W-30 |
| ASTM D445 Kinematic Viscosity 100 °C, cSt | 10.2 | 10.3 | 10.2 | 10.2 | 10.3 | 10.3 | 10.3 | 10.4 | 10.3 | 10.3 |
| ASTM D4683 HTHS Viscosity, cP | 3.0 | 3.0 | 3.0 | 3.0 | 3.0 | 3.0 | 3.0 | 2.9 | 3.0 | 2.9 |
| ASTM D5293 CCS Viscosity @-35 °C, cP | 4309 | 4825 | 4748 | 4131 | 3962 | 4380 | 4375 | 4439 | 4339 | 4368 |
| Mg, ppm | 0 | 0 | 0 | 0 | 0 | 0 | 0 | 0 | 0 | 0 |
| Ca, ppm | 2200 | 2160 | 2160 | 2160 | 2170 | 2150 | 2150 | 2150 | 2220 | 2140 |
| B, ppm | 100 | 100 | 100 | 100 | 100 | 100 | 100 | 100 | 100 | 100 |
| Zn, ppm | 830 | 830 | 830 | 830 | 830 | 830 | 830 | 830 | 830 | 830 |
| P, ppm | 760 | 760 | 760 | 760 | 760 | 760 | 760 | 760 | 760 | 760 |
| Mo, ppm | 160 | 160 | 160 | 160 | 160 | 160 | 160 | 160 | 160 | 160 |
| Detergent Soap, wt% | 1.08 | 1.08 | 1.08 | 1.08 | 1.08 | 1.08 | 1.08 | 1.08 | 1.08 | 1.08 |
| ASTM D2896 Total Base Number, mgKOH/g | 7.3 | 7.1 | 7.3 | 8.6 | 9.9 | 8.6 | 8.5 | 9.8 | 8.6 | 9.9 |
| ASTM D4739 Total Base Number, mgKOH/g | 6.8 | 6.8 | 6.6 | 6.7 | 6.7 | 6.8 | 6.8 | 6.5 | 6.7 | 6.5 |
| ASTM D874 Sulfated Ash, wt% | 0.9 | 0.9 | 0.9 | 0.9 | 0.9 | 0.9 | 0.9 | 0.9 | 0.9 | 0.9 |
| Noack Volatility, % | 11.7 | 12.1 | 11.7 | 11.8 | 11.9 | 11.9 | 12.0 | 12.4 | 11.6 | 11.9 |
| IR Oxidation @ 216 Hr with B100, (A/cm) | 130.2 | 53.9 | 54.2 | 39.4 | 23.2 | 32.5 | 33.7 | 39.0 | 34.1 | 37.6 |
| IR Oxidation @ 240 Hr with B100, (A/cm) | 136.2 | 59.8 | 60.2 | 31.6 | 24.8 | 34.2 | 35.6 | 40.3 | 35.7 | 39.0 |
| KV100 inc. @ 216 Hr with B100, % | 251.3 | 80.3 | 143.5 | 49.1 | 51.8 | 73.7 | 54.7 | 73.8 | 62.4 | 58.1 |
| KV100 inc. @ 240 Hr with B100, % | >1000 | 177.8 | 373.3 | 72.7 | 68.4 | 107.8 | 88.3 | 98.8 | 88.2 | 71.8 |

Fig. 2

| | Comparitive Example 11 | Comparitive Example 12 | Comparitive Example 13 | Example 1 | Example 2 | Example 3 | Example 4 | Example 5 | Example 6 | Example 7 |
|---|---|---|---|---|---|---|---|---|---|---|
| | Ca Sulfonate | | | | | | | | | |
| Group III Basestock | 40 | 40 | 40 | 40 | 40 | 40 | 40 | 40 | 40 | 40 |
| Group IV Basestock | 39.2 | 36.5 | 36.9 | 36.5 | 37.7 | 37.7 | 37.1 | 35.0 | 37.3 | 35.4 |
| Group V Basestock | 5 | 5 | 5 | 5 | 5 | 5 | 5 | 5 | 5 | 5 |
| Ca Sulfonate Detergent | 1.9 | 1.9 | 1.9 | 1.9 | 1.9 | 1.9 | 1.9 | 1.9 | 1.9 | 1.9 |
| Ca Salicylate Detergent 1 | -- | -- | -- | -- | -- | -- | -- | -- | -- | -- |
| Ca Salicylate Detergent 2 | -- | -- | -- | -- | -- | -- | -- | -- | -- | -- |
| Aminic AO | -- | -- | -- | 0.8 | 1.5 | 0.8 | 0.8 | 1.5 | 0.8 | 1.5 |
| Phenolic AO 1 | -- | -- | -- | -- | -- | 0.8 | -- | -- | -- | -- |
| Phenolic AO 2 | -- | 2.8 | -- | -- | -- | -- | 1.4 | 2.8 | -- | -- |
| Phenolic AO 3 | -- | -- | 2.4 | -- | -- | -- | -- | -- | 1.2 | 2.4 |
| Other Lubricating Additives | 13.9 | 13.9 | 13.9 | 13.9 | 13.9 | 13.9 | 13.9 | 13.9 | 13.9 | 13.9 |
| Total | 100 | 100 | 100 | 100 | 100 | 100 | 100 | 100 | 100 | 100 |
| Viscosity Grade | 0W-30 | 0W-30 | 0W-30 | 0W-30 | 0W-30 | 0W-30 | 0W-30 | 0W-30 | 0W-30 | 0W-30 |
| ASTM D445 Kinematic Viscosity 100 °C, cSt | 9.8 | 9.9 | 9.8 | 9.9 | 9.9 | 9.9 | 9.8 | 10.0 | 9.9 | 9.9 |
| ASTM D4683 HTHS Viscosity, cP | 2.9 | 2.9 | 2.9 | 2.9 | 2.9 | 2.9 | 2.9 | 2.9 | 2.9 | 2.9 |
| ASTM D5293 CCS Viscosity @-35 °C, cP | 4637 | 4675 | 4577 | 3901 | 3789 | 4110 | 4196 | 4065 | 4153 | 4273 |
| Mg, ppm | 0 | 0 | 0 | 0 | 0 | 0 | 0 | 0 | 0 | 0 |
| Ca, ppm | 2180 | 2160 | 2170 | 2160 | 2190 | 2160 | 2160 | 2160 | 2160 | 2190 |
| B, ppm | 100 | 100 | 100 | 100 | 100 | 100 | 100 | 100 | 100 | 100 |
| Zn, ppm | 830 | 830 | 830 | 830 | 830 | 830 | 830 | 830 | 830 | 830 |
| P, ppm | 760 | 760 | 760 | 760 | 760 | 760 | 760 | 760 | 760 | 760 |
| Mo, ppm | 160 | 160 | 160 | 160 | 160 | 160 | 160 | 160 | 160 | 160 |
| Detergent Soap, wt% | 1.01 | 1.01 | 1.01 | 1.01 | 1.01 | 1.01 | 1.01 | 1.01 | 1.01 | 1.01 |
| ASTM D2896 Total Base Number, mgKOH/g | 6.9 | 6.9 | 7.1 | 8.3 | 9.6 | 8.3 | 8.3 | 9.6 | 8.4 | 9.9 |
| ASTM D4739 Total Base Number, mgKOH/g | 6.4 | 6.4 | 6.4 | 6.4 | 6.4 | 6.4 | 6.4 | 6.4 | 6.4 | 6.4 |
| ASTM D874 Sulfated Ash, wt% | 0.9 | 0.9 | 0.9 | 0.9 | 0.9 | 0.9 | 0.9 | 0.9 | 0.9 | 0.9 |
| Noack Volatility, % | 11.7 | 12.2 | 11.6 | 11.8 | 11.9 | 11.9 | 12.5 | 12.4 | 11.8 | 11.9 |
| IR Oxidation @ 216 Hr with B100, (A/cm) | 150.5 | 104.6 | 101.8 | 38.2 | 24.7 | 34.4 | 39.3 | 41.4 | 37.9 | 38.9 |
| IR Oxidation @ 240 Hr with B100, (A/cm) | 158.3 | 114.7 | 112.6 | 44.6 | 25.4 | 37.6 | 42.9 | 42.7 | 41.6 | 48.3 |
| KV100 inc. @ 216 Hr with B100, % | 149.7 | 109.2 | 110.1 | 1.4 | 10.5 | 2.6 | 3.5 | 12.6 | 3.3 | 12.5 |
| KV100 inc. @ 240 Hr with B100, % | 453.8 | 342.1 | 347.8 | 8.0 | 12.7 | 5.2 | 7.6 | 17.7 | 8.9 | 16.8 |

Fig. 3

| | Example 8 | Example 9 | Example 10 | Example 11 | Comparitive Example 14 | Comparitive Example 15 | Comparitive Example 16 |
|---|---|---|---|---|---|---|---|
| Group III Basestock | 40 | 40 | 40 | 40 | 40 | 40 | 40 |
| Group IV Basestock | 38.6 | 37.8 | 37.8 | 36.3 | 34.6 | 35.2 | 33.8 |
| Group V Basestock | 5 | 5 | 5 | 5 | 5 | 5 | 5 |
| Calcium Sulfonate Detergent | -- | -- | -- | -- | -- | -- | -- |
| Calcium Salicylate Detergent 1 | -- | -- | -- | -- | 2 | 4.4 | 6 |
| Calcium Salicylate Detergent 2 | -- | -- | -- | -- | 3 | -- | -- |
| Mg Sulfonate Detergent | | 0.8 | 1.6 | 2.4 | -- | -- | -- |
| Non Borated Dispersant 1 | -- | -- | -- | -- | -- | -- | -- |
| Non Borated Dispersant 2 | 5.0 | 5.0 | 5.0 | 5.0 | 3.3 | 3.3 | 3.3 |
| Low B/N Dispersant | -- | -- | -- | -- | 1.3 | 1.3 | 1.3 |
| Other Lubricating Additives | 11.3 | 11.5 | 11.5 | 11.5 | 10.8 | 10.8 | 10.8 |
| Total | 100 | 100 | 100 | 100 | 100 | 100 | 100 |
| Viscosity Grade | 0W-30 | 0W-30 | 0W-30 | 0W-30 | 0W-30 | 0W-30 | 0W-30 |
| ASTM D445 Kinematic Viscosity 100 °C, cSt | 10.1 | 10.2 | 10.3 | 10.4 | 10.3 | 10.3 | 10.5 |
| ASTM D4683 HTHS Viscosity, cP | 2.9 | 3.0 | 3.0 | 3.0 | 3.0 | 3.0 | 3.0 |
| ASTM D5293 CCS Viscosity @-35 °C, cP | 3955 | 3734 | 3523 | 3325 | 4340 | 4297 | 4517 |
| Mg, ppm | 0 | 710 | 1429 | 2139 | 0 | 0 | 0 |
| Ca, ppm | 0 | 0 | 0 | 0 | 2150 | 3190 | 4260 |
| B, ppm | 0 | 0 | 0 | 0 | 100 | 100 | 100 |
| Zn, ppm, | 830 | 830 | 830 | 830 | 830 | 830 | 830 |
| P, ppm | 760 | 760 | 760 | 760 | 760 | 760 | 760 |
| Mo, ppm | 160 | 160 | 160 | 160 | 160 | 160 | 160 |
| S, ppm | 1580 | 1730 | 1880 | 2030 | 1580 | 1580 | 1580 |
| N, ppm | 980 | 975 | 1000 | 1030 | 938 | 938 | 938 |
| Detergent Soap, wt% | 0.00 | 0.20 | 0.41 | 0.61 | 1.48 | 1.19 | 1.59 |
| ASTM D2896 Total Base Number, mgKOH/g | 1.4 | 4.5 | 7.7 | 10.9 | 7.7 | 10.6 | 13.6 |
| ASTM D4739 Total Base Number, mgKOH/g | 0.9 | 4.1 | 7.3 | 10.4 | 6.8 | 9.7 | 12.7 |
| ASTM D874 Sulfated Ash, wt% | 0.1 | 0.5 | 0.8 | 1.2 | 0.9 | 1.2 | 1.6 |
| B/N | 0.0 | 0.0 | 0.0 | 0.0 | 0.1 | 0.1 | 0.1 |
| CEC L-109-14 FTIR Oxidation @ 216h, A/cm | 28.2 | 37.6 | 67.1 | 85.2 | 32.5 | 31.35 | 28.6 |
| CEC L-109-14 FTIR Oxidation @ 240h, A/cm | 28.8 | 39.2 | 77.5 | 100.3 | 34.2 | 33.7 | 30.8 |
| CEC L-109-14 Rel. KV100 Increase 100 °C at 216 hours, % | 20.2 | 27.2 | 105.8 | 116.9 | 73.7 | 107.0 | 157.4 |
| CEC L-109-14 Rel. KV100 Increase 100 °C at 240 hours, % | 26.5 | 42.3 | 350.0 | 453.1 | 107.8 | 354.3 | 299.4 |

Fig. 4

| | Comparitive Example 17 | Comparitive Example 18 | Comparitive Example 19 |
|---|---|---|---|
| Group IV Basestock | 76.8 | 77.0 | 80.3 |
| Ashless AOs | 1.5 | -- | 1.5 |
| Calcium Salicylate Detergent 1 | 1.9 | 1.9 | -- |
| Magnesium Sulfonate Detergent | 0.8 | 0.8 | -- |
| Non-Borated Dispersant 2 | 4 | 4 | -- |
| Low B/N Borated Dispersant | 1.5 | 1.5 | -- |
| Antiwear Additive | 0.7 | -- | 0.7 |
| Other Lubricating Additives | 12.7 | 14.8 | 17.5 |
| | | | |
| Total | 100 | 100 | 100 |
| | | | |
| ASTM D445 Kinematic Viscosity 100 °C, cSt | 9.3 | 10.1 | 8.2 |
| ASTM D4683 HTHS Viscosity, cP | 2.6 | 2.7 | 2.2 |
| ASTM D5293 CCS Viscosity @-35 °C, cP | 3435 | 3233 | 2477 |
| Mg, ppm | 772 | 772 | 0 |
| Ca, ppm | 1387 | 1387 | 0 |
| B, ppm | 115.5 | 115.5 | 0 |
| Zn, ppm, | 716 | 0 | 716 |
| P, ppm | 655 | 0 | 655 |
| Mo, ppm | 83 | 83 | 83 |
| S, ppm | 1668 | 306 | 1510 |
| N, ppm | 1116 | 774 | 363 |
| Detergent Soap, wt% | 0.74 | 0.74 | 0.00 |
| ASTM D2896 Total Base Number, mgKOH/g | 10.1 | 8.8 | 1.4 |
| ASTM D4739 Total Base Number, mgKOH/g | 8.2 | 8.2 | 0.0 |
| ASTM D874 Sulfated Ash, wt% | 1.0 | 0.8 | 0.2 |
| B/N | 0.1 | 0.1 | 0.0 |
| | | | |
| ASTM D7320 Seq IIIG WPD, merits | 5.82 | 4.85 | 0.96 |
| ASTM D7320 Seq IIIG PVIS, % | 71.38 | 138.54 | -38.73 |

Fig. 5

| | Comparitive Example 20 | Comparitive Example 21 | Comparitive Example 22 | Comparitive Example 23 | Example 12 | Example 13 | Example 14 | Example 15 | Example 16 |
|---|---|---|---|---|---|---|---|---|---|
| Low B/N Dispersant | -- | -- | -- | 3.8 | -- | -- | -- | 3.8 | -- |
| Mid B/N Dispersant | -- | -- | -- | -- | -- | -- | -- | -- | -- |
| High B/N Dispersant | -- | 1.3 | -- | -- | -- | 1.3 | -- | -- | 4.7 |
| Other Lubricating Additives | 11.5 | 11.5 | 11.5 | 11.5 | 11.5 | 11.5 | 11.5 | 11.5 | 11.5 |
| Total | 100 | 100 | 100 | 100 | 100 | 100 | 100 | 100 | 100 |
| Viscosity Grade | 0W-30 | 0W-30 | 0W-30 | 0W-30 | 0W-30 | 0W-30 | 0W-30 | 0W-30 | 0W-30 |
| ASTM D445 Kinematic Viscosity 100 °C, cSt | 10.4 | 10.2 | 10.6 | 9.7 | 10.1 | 9.9 | 10.3 | 9.5 | 9.3 |
| ASTM D4683 HTHS Viscosity, cP | 3.0 | 3.0 | 3.0 | 2.9 | 2.9 | 2.9 | 2.8 | 2.8 | 2.8 |
| ASTM D5293 CCS Viscosity @-35 °C, cP | 4383 | 4529 | 4643 | 4077 | 4213 | 4353 | 4482 | 3919 | 4227 |
| Mg, ppm | 0 | 0 | 0 | 0 | 0 | 0 | 0 | 0 | 0 |
| Ca, ppm | 2150 | 2150 | 2150 | 2150 | 2123 | 2123 | 2123 | 2123 | 2123 |
| B, ppm | 0 | 313 | 0 | 293 | 0 | 313 | 0 | 293 | 1168 |
| Zn, ppm, | 830 | 832 | 832 | 830 | 830 | 832 | 830 | 830 | 832 |
| P, ppm | 760 | 761 | 761 | 760 | 760 | 761 | 760 | 760 | 761 |
| Mo, ppm | 161 | 158 | 158 | 161 | 161 | 158 | 161 | 161 | 158 |
| S, ppm | 1580 | 1582 | 1582 | 1580 | 1580 | 1582 | 1580 | 1580 | 1582 |
| N, ppm | 937 | 921 | 938 | 939 | 937 | 921 | 937 | 939 | 932 |
| Detergent Soap, wt% | 1.48 | 1.48 | 1.48 | 1.48 | 0.53 | 0.53 | 0.53 | 0.53 | 0.53 |
| ASTM D2896 Total Base Number, mgKOH/g | 8.2 | 7.4 | 7.4 | 8.4 | 7.6 | 6.9 | 6.9 | 7.8 | 8.08 |
| ASTM D4739 Total Base Number, mgKOH/g | 7.1 | 6.9 | 6.9 | 6.6 | 6.5 | 6.4 | 6.4 | 6.1 | 6.4 |
| ASTM D874 Sulfated Ash, wt% | 0.9 | 0.9 | 0.9 | 1.0 | 0.8 | 0.8 | 0.8 | 0.9 | 1.2 |
| B/N | 0 | 0.3 | 0 | 0.3 | 0 | 0.3 | 0 | 0.3 | 1.3 |
| CEC L-109 -14 FTIR Oxidation @ 216h, A/cm | 36.6 | 34 | 34.8 | 33.3 | 37.9 | 34.5 | 38.3 | 32.3 | 29.4 |
| CEC L-109 -14 FTIR Oxidation @ 240h, A/cm | 39.2 | 35.5 | 37.2 | 35.4 | 41.6 | 37.6 | 42 | 37.4 | 30.2 |
| CEC L-109-14 Rel. KV100 Increase 100 °C at 216 hours, % | 19.0 | 106.1 | 18.0 | 46.5 | 0.3 | 7.9 | -2.3 | 19.7 | 58.4 |
| CEC L-109-14 Rel. KV100 Increase 100 °C at 240 hours, % | 26.6 | 144.5 | 25.6 | 57.0 | 3.2 | 11.1 | 0.3 | 25.4 | 66.4 |

Fig. 6

| | Comparitive Example 24 | Comparitive Example 25 | Comparitive Example 26 | Comparitive Example 27 | Comparitive Example 28 | Example 37 |
|---|---|---|---|---|---|---|
| Non Borated Dispersant 1 | 5.9 | -- | -- | -- | -- | -- |
| Non Borated Dispersant 2 | -- | 5.8 | -- | 3.5 | -- | -- |
| Non Borated Dispersant 3 | -- | -- | -- | -- | 4.5 | -- |
| Low B/N Dispersant | -- | -- | 3.8 | -- | -- | -- |
| Mid B/N Dispersant | -- | -- | -- | -- | -- | -- |
| High B/N Dispersant | -- | -- | -- | 1.3 | -- | 4.7 |
| Other Lubricating Additives | 11.5 | 11.5 | 11.5 | 11.5 | 11.5 | 11.5 |
| Total | 100 | 100 | 100 | 100 | 100 | 100 |
| Viscosity Grade | 0W-30 | 0W-30 | 0W-30 | 0W-30 | 0W-30 | 0W-30 |
| ASTM D445 Kinematic Viscosity 100 °C, cSt | 10.1 | 10.4 | 9.6 | 10.0 | 9.4 | 9.3 |
| ASTM D4683 HTHS Viscosity, cP | 2.9 | 3.0 | 2.9 | 2.9 | 2.9 | 2.9 |
| ASTM D5293 CCS Viscosity @-35 °C, cP | 3140 | 3325 | 2920 | 3043 | 3149 | 3149 |
| Mg, ppm | 2139 | 2139 | 2139 | 2139 | 2139 | 2139 |
| Ca, ppm | 0 | 0 | 0 | 0 | 0 | 0 |
| B, ppm | 0 | 0 | 293 | 313 | 1168 | 1168 |
| Zn, ppm, | 832 | 832 | 832 | 832 | 832 | 832 |
| P, ppm | 761 | 761 | 761 | 761 | 761 | 761 |
| Mo, ppm | 158 | 158 | 158 | 158 | 158 | 158 |
| S, ppm | 2029 | 2029 | 2029 | 2029 | 2029 | 2029 |
| N, ppm | 1043 | 1043 | 1046 | 1027 | 1016 | 1038 |
| Detergent Soap, wt% | 0.61 | 0.61 | 0.61 | 0.61 | 0.61 | 0.61 |
| ASTM D2896 Total Base Number, mgKOH/g | 11.7 | 10.9 | 11.9 | 10.9 | 12.9 | 10.9 |
| ASTM D4739 Total Base Number, mgKOH/g | 10.6 | 10.4 | 10.1 | 10.4 | 10.9 | 10.5 |
| ASTM D874 Sulfated Ash, wt% | 1.2 | 1.2 | 1.3 | 1.2 | 1.2 | 1.2 |
| B/N | 0.0 | 0.0 | 0.3 | 0.3 | 0.0 | 1.1 |
| CEC L-109-14 FTIR Oxidation @ 216h, A/cm | 80.3 | 85.2 | 69.9 | 73.4 | 57.0 | 43.8 |
| CEC L-109-14 FTIR Oxidation @ 240h, A/cm | 96.2 | 100.3 | 81.4 | 81.3 | | 49.8 |
| CEC L-109-14 Rel. KV100 Increase 100 °C at 216 hours, % | 98.5 | 116.8 | 423.2 | 648.0 | 110.41 | 77.6 |
| CEC L-109-14 Rel. KV100 Increase 100 °C at 240 hours, % | 303.6 | 452.8 | 725.2 | 808.8 | | 82.2 |

Fig. 7

| | Comparitive Example 29 | Comparitive Example 30 | Comparitive Example 31 | Comparitive Example 32 | Comparitive Example 33 | Comparitive Example 34 | Example 18 | Example 19 | Example 20 | Example 21 | Example 22 | Example 23 | Example 24 | Example 25 | Example 26 |
|---|---|---|---|---|---|---|---|---|---|---|---|---|---|---|---|
| Group III Basestock | 40 | 40 | 40 | 40 | 40 | 40 | 40 | 40 | 40 | 40 | 40 | 40 | 40 | 40 | 40 |
| Group IV Basestock | 46.7 | 43.7 | 40.4 | 37.2 | 33.9 | 30.7 | 41.8 | 39.9 | 37.9 | 36.0 | 42.7 | 41.7 | 40.7 | 39.7 | 44.1 |
| Group V Basestock | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 |
| Low B/N Dispersant | -- | -- | 3.3 | 6.5 | 9.8 | 13.0 | -- | -- | -- | -- | -- | -- | -- | -- | -- |
| Mid B/N Dispersant | -- | -- | -- | -- | -- | -- | 1.9 | 3.8 | 5.8 | 7.7 | -- | -- | -- | -- | -- |
| High B/N Dispersant | -- | -- | -- | -- | -- | -- | -- | -- | -- | -- | 1.0 | 2.0 | 3.0 | 4.0 | 0.4 |
| Non Borated Dispersant 1 | -- | -- | -- | -- | -- | -- | -- | -- | -- | -- | -- | -- | -- | -- | -- |
| Non Borated Dispersant 2 | -- | -- | -- | -- | -- | -- | -- | -- | -- | -- | -- | -- | -- | -- | -- |
| Non Borated Dispersant 3 | -- | -- | -- | -- | -- | -- | -- | -- | -- | -- | -- | -- | -- | -- | 0.6 |
| Mg Sulfonate Detergent | -- | 2.0 | 2.0 | 2.0 | 2.0 | 2.0 | 2.0 | 2.0 | 2.0 | 2.0 | 2.0 | 2.0 | 2.0 | 2.0 | 0.6 |
| Ca Sulfonate Detergent | -- | -- | -- | -- | -- | -- | -- | -- | -- | -- | -- | -- | -- | -- | -- |
| Other Lubricating Additives | 9.3 | 9.3 | 9.3 | 9.3 | 9.3 | 9.3 | 9.3 | 9.3 | 9.3 | 9.3 | 9.3 | 9.3 | 9.3 | 9.3 | 9.3 |
| Total | 100 | 100 | 100 | 100 | 100 | 100 | 100 | 100 | 100 | 100 | 100 | 100 | 100 | 100 | 100 |
| Viscosity Grade | 0W-12 | 0W-12 | 0W-16 | 0W-20 | 0W-30 | 0W-30 | 0W-12 | 0W-16 | 0W-18 | 0W-20 | 0W-12 | 0W-16 | 0W-16 | 0W-16 | 0W-12 |
| ASTM D445 Kinematic Viscosity 100 °C, cSt | 6.6 | 6.4 | 7.5 | 8.8 | 10.3 | 12.1 | 6.9 | 7.5 | 8.0 | 8.7 | 6.7 | 6.5 | 7.1 | 7.4 | 6.387 |
| ASTM D4683 HTHS Viscosity, cP | 2.6 | 2.2 | 2.4 | 2.6 | 2.9 | 3.2 | 2.3 | 2.3 | 2.4 | 2.6 | 2.3 | 2.3 | 2.4 | 2.4 | 2.1 |
| ASTM D5293 CCS Viscosity @ -35 °C, cP | 2547 | 2198 | 2802 | 3973 | 4558 | 5808 | 2237 | 2277 | 2318 | 2359 | 2373 | 2563 | 2768 | 2980 | 2642 |
| Mg, ppm | 0 | 1820 | 1820 | 1820 | 1820 | 1820 | 1820 | 1820 | 1820 | 1820 | 1820 | 1820 | 1820 | 1820 | 501 |
| Ca, ppm | 0 | 0 | 0 | 0 | 0 | 0 | 0 | 0 | 0 | 0 | 0 | 0 | 0 | 0 | 0 |
| B, ppm | 0 | 0 | 250 | 501 | 751 | 1001 | 250 | 499 | 750 | 1000 | 250 | 500 | 750 | 1000 | 100 |
| Zn, ppm | 832 | 832 | 832 | 832 | 832 | 832 | 832 | 832 | 832 | 832 | 832 | 832 | 832 | 832 | 832 |
| P, ppm | 761 | 761 | 761 | 761 | 761 | 761 | 761 | 761 | 761 | 761 | 761 | 761 | 761 | 761 | 761 |
| Mo, ppm | 158 | 158 | 158 | 158 | 158 | 158 | 158 | 158 | 158 | 158 | 158 | 158 | 158 | 158 | 158 |
| S, ppm | 1580 | 1962 | 1962 | 1962 | 1962 | 1962 | 1962 | 1962 | 1962 | 1962 | 1962 | 1962 | 1962 | 1962 | 1687 |
| N, ppm | 394 | 484 | 994 | 1504 | 2014 | 2525 | 721 | 958 | 1196 | 1433 | 610 | 736 | 862 | 989 | 544 |
| Detergent Soap, wt% | 0.08 | 0.48 | 0.48 | 0.48 | 0.48 | 0.48 | 0.48 | 0.48 | 0.48 | 0.48 | 0.48 | 0.48 | 0.48 | 0.48 | 0.13 |
| ASTM D2896 Total Base Number, mgKOH/g | 1.4 | 9.5 | 10.3 | 11.1 | 12.0 | 12.8 | 9.7 | 9.9 | 10.2 | 10.4 | 9.6 | 9.8 | 9.9 | 10.1 | 3.7 |
| ASTM D4739 Total Base Number, mgKOH/g | 0.0 | 8.1 | 8.6 | 9.1 | 9.5 | 10.0 | 8.4 | 8.8 | 9.1 | 9.4 | 8.3 | 8.5 | 8.7 | 8.9 | 2.5 |
| ASTM D874 Sulfated Ash, wt% | 0.1 | 1.0 | 1.1 | 1.2 | 1.3 | 1.4 | 1.1 | 1.2 | 1.3 | 1.3 | 1.1 | 1.2 | 1.3 | 1.3 | 0.41 |
| B/N | 0.0 | 0.6 | 0.3 | 0.3 | 0.4 | 0.4 | 0.3 | 0.5 | 0.6 | 0.7 | 0.4 | 0.7 | 0.8 | 1.0 | 0.18 |
| CEC L-109-14 FTIR Oxidation @ 216h, A/cm | 12.5 | 60.7 | 72.2 | 82.5 | 43 | 40.2 | 81.4 | 60.5 | 49.9 | 47 | 55.8 | 60.7 | 48.1 | 44.8 | 23.6 |
| CEC L-109-14 Rel. KV100 Increase 100 °C at 216 hours, % | -13.8 | -4.5 | 272.1 | 598.6 | 130.4 | 84.5 | 8.8 | 19.0 | 170.2 | 828.1 | 1.5 | 4.6 | 13.9 | 44.3 | -3.3 |

Fig. 8

| | Comparitive Example 29 | Comparitive Example 35 | Example 27 | Example 28 | Example 29 | Example 30 | Example 31 |
|---|---|---|---|---|---|---|---|
| Group III Basestock | 40 | 40 | 40 | 40 | 40 | 40 | 40 |
| Group IV Basestock | 46.7 | 44.1 | 43.1 | 42.1 | 41.1 | 40.1 | 44.3 |
| Group V Basestock | 5.0 | 5.0 | 5.0 | 5.0 | 5.0 | 5.0 | 5.0 |
| Low B/N Dispersant | -- | -- | -- | -- | -- | -- | -- |
| Mid B/N Dispersant | -- | -- | -- | -- | -- | -- | -- |
| High B/N Dispersant | -- | -- | 1.0 | 2.0 | 3.0 | 4.0 | 0.4 |
| Non Borated Dispersant 1 | -- | -- | -- | -- | -- | -- | -- |
| Non Borated Dispersant 2 | -- | -- | -- | -- | -- | -- | -- |
| Non Borated Dispersant 3 | -- | -- | -- | -- | -- | -- | 0.6 |
| Mg Sulfonate Detergent | -- | -- | -- | -- | -- | -- | -- |
| Ca Sulfaonte Detergent | -- | 1.6 | 1.6 | 1.6 | 1.6 | 1.6 | 0.4 |
| Other Lubricating Additives | 9.3 | 9.3 | 9.3 | 9.3 | 9.3 | 9.3 | 9.3 |
| Total | 100 | 100 | 100 | 100 | 100 | 100 | 100 |
| Viscosity Grade | 0W-12 | 0W-12 | 0W-12 | 0W-12 | 0W-12 | 0W-16 | 0W-12 |
| ASTM D445 Kinematic Viscosity 100 °C, cSt | 6.0 | 6.3 | 6.5 | 6.7 | 7.0 | 7.2 | 6.287 |
| ASTM D4683 HTHS Viscosity, cP | 2.0 | 2.1 | 2.1 | 2.2 | 2.2 | 2.3 | 2.1 |
| ASTM D5293 CCS Viscosity @ 35 °C, cP | 2547 | 2825 | 3051 | 3296 | 3559 | 3844 | 2836 |
| Mg, ppm | 0 | 0 | 0 | 0 | 0 | 0 | 0 |
| Ca, ppm | 0 | 1821 | 1821 | 1821 | 1821 | 1821 | 499 |
| B, ppm | 0 | 0 | 250 | 500 | 750 | 1000 | 100 |
| Zn, ppm | 832 | 832 | 832 | 832 | 832 | 832 | 832 |
| P, ppm | 761 | 761 | 761 | 761 | 761 | 761 | 761 |
| Mo, ppm | 158 | 158 | 158 | 158 | 158 | 158 | 158 |
| S, ppm | 1582 | 1582 | 1582 | 1582 | 1582 | 1582 | 1582 |
| N, ppm | 394 | 394 | 520 | 646 | 772 | 898 | 520 |
| Detergent Soap, wt% | 0.00 | 0.42 | 0.42 | 0.42 | 0.42 | 0.42 | 0.11 |
| ASTM D2896 Total Base Number, mgKOH/g | 1.4 | 6.1 | 6.2 | 6.4 | 6.5 | 6.7 | 2.8 |
| ASTM D4739 Total Base Number, mgKOH/g | 0.0 | 4.7 | 4.9 | 5.1 | 5.3 | 5.5 | 1.6 |
| ASTM D874 Sulfated Ash, wt% | 0.1 | 0.7 | 0.8 | 0.9 | 1.0 | 1.1 | 0.33 |
| B/N | 0.0 | 0.0 | 0.5 | 0.8 | 1.0 | 1.1 | 0.19 |
| CEC L-109-14 FTIR Oxidation @ 216h, A/cm | 12.5 | 47.1 | 37.4 | 30.9 | 29.7 | 31 | 13.8 |
| CEC L-109-14 Rel. KV100 Increase 100 °C at 216 hours, % | -13.8 | -2.8 | 6.5 | 9.2 | 25.5 | 67.5 | 0.6 |

Fig. 9

| | Comparitive Example 29 | Example 32 | Example 33 | Example 34 | Example 35 | Example 36 |
|---|---|---|---|---|---|---|
| Group III Basestock | 40 | 40 | 40 | 40 | 40 | 40 |
| Group IV Basestock | 45.7 | 43.3 | 42.3 | 41.3 | 40.3 | 39.3 |
| Group V Basestock | 5.0 | 5.0 | 5.0 | 5.0 | 5.0 | 5.0 |
| Low B/N Dispersant | -- | -- | -- | -- | -- | -- |
| Mid B/N Dispersant | -- | -- | -- | -- | -- | -- |
| High B/N Dispersant | -- | -- | 1.0 | 2.0 | 3.0 | 4.0 |
| Non Borated Dispersant 1 | -- | -- | -- | -- | -- | -- |
| Non Borated Dispersant 2 | -- | -- | -- | -- | -- | -- |
| Non Borated Dispersant 3 | -- | -- | -- | -- | -- | -- |
| Mg Sulfonate Detergent | -- | 0.8 | 0.8 | 0.8 | 0.8 | 0.8 |
| Ca Sulfonate Detergent | -- | 1.6 | 1.6 | 1.6 | 1.6 | 1.6 |
| Other Lubricating Additives | 9.3 | 9.3 | 9.3 | 9.3 | 9.3 | 9.3 |
| Total | 100 | 100 | 100 | 100 | 100 | 100 |
| Viscosity Grade | 0W-12 | 0W-12 | 0W-12 | 0W-12 | 0W-16 | 0W-16 |
| ASTM D445 Kinematic Viscosity 100 °C, cSt | 6.0 | 6.5 | 6.7 | 6.9 | 7.2 | 7.5 |
| ASTM D4683 HTHS Viscosity, cP | 2.0 | 2.1 | 2.2 | 2.2 | 2.3 | 2.4 |
| ASTM D5293 CCS Viscosity @-35 °C, cP | 2547 | 2658 | 2870 | 3100 | 3348 | 3616 |
| Mg, ppm | 0 | 755 | 755 | 755 | 755 | 755 |
| Ca, ppm | 0 | 1821 | 1821 | 1821 | 1821 | 1821 |
| B, ppm | 0 | 0 | 250 | 500 | 750 | 1000 |
| Zn, ppm | 832 | 832 | 832 | 832 | 832 | 832 |
| P, ppm | 761 | 761 | 761 | 761 | 761 | 761 |
| Mo, ppm | 158 | 158 | 158 | 158 | 158 | 158 |
| S, ppm | 1582 | 1740 | 1740 | 1740 | 1740 | 1740 |
| N, ppm | 394 | 431 | 567 | 683 | 809 | 935 |
| Detergent Soap, wt% | 0 | 0.61 | 0.61 | 0.61 | 0.61 | 0.61 |
| ASTM D2896 Total Base Number, mgKOH/g | 1.4 | 9.4 | 9.6 | 9.7 | 9.9 | 10.0 |
| ASTM D4739 Total Base Number, mgKOH/g | 0.0 | 8.1 | 8.3 | 8.5 | 8.7 | 8.9 |
| ASTM D874 Sulfated Ash, wt% | 0.1 | 1.1 | 1.2 | 1.3 | 1.4 | 1.4 |
| B/N | 0.0 | 0.8 | 0.4 | 0.7 | 0.9 | 1.1 |
| CEC L-109-14 FTIR Oxidation @ 216h, A/cm | 12.5 | 91.9 | 77.9 | 49.9 | 45.1 | 38.8 |
| CEC L-109-14 Rel. KV100 Increase 100 °C at 216 hours, % | -13.8 | 6.6 | 13.3 | 14.4 | 17.1 | 46.4 |

Fig. 10

| | Comparitive Example 36 | Comparitive Example 37 | Comparitive Example 38 | Comparitive Example 39 | Comparitive Example 40 | Comparitive Example 41 | Comparitive Example 42 | Comparitive Example 43 | Comparitive Example 44 | Example 37 | Example 38 | Example 39 | Example 40 | Example 41 | Example 42 | Example 43 | Example 44 | Example 45 |
|---|---|---|---|---|---|---|---|---|---|---|---|---|---|---|---|---|---|---|
| Group II Basestock | 77.2 | 73.9 | 70.7 | – | – | – | – | – | – | 81.7 | 80.7 | 79.7 | – | – | – | – | – | – |
| Group III Basestock | – | – | – | 77.2 | 73.9 | 70.7 | – | – | – | – | – | – | 81.7 | 80.7 | 79.7 | – | – | – |
| Group IV Basestock | – | – | – | – | – | – | 77.2 | 73.9 | 70.7 | – | – | – | – | – | – | 81.7 | 80.7 | 79.7 |
| Group V Basestock | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 |
| Magnesium Sulfonate Detergent | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 |
| Low B/N Borated Dispersant | 6.5 | 9.8 | 13.0 | 6.5 | 9.8 | 13.0 | 6.5 | 9.8 | 13.0 | – | – | – | – | – | – | – | – | – |
| High B/N Borated Dispersant | – | – | – | – | – | – | – | – | – | 2.0 | 3.0 | 4.0 | 2.0 | 3.0 | 4.0 | 2.0 | 3.0 | 4.0 |
| Other Lubricating Additives | 9.3 | 9.3 | 9.3 | 9.3 | 9.3 | 9.3 | 9.3 | 9.3 | 9.3 | 9.3 | 9.3 | 9.3 | 9.3 | 9.3 | 9.3 | 9.3 | 9.3 | 9.3 |
| Total | 100 | 100 | 100 | 100 | 100 | 100 | 100 | 100 | 100 | 100 | 100 | 100 | 100 | 100 | 100 | 100 | 100 | 100 |
| Viscosity Grade | 0W-20 | 5W-30 | 5W-30 | 0W-16 | 0W-20 | 0W-30 | 0W-20 | 0W-30 | 0W-30 | 0W-16 | 0W-16 | 5W-16 | 0W-12 | 0W-12 | 0W-16 | 0W-12 | 0W-12 | 0W-16 |
| ASTM D445 Kinematic Viscosity 100 °C, cSt | 10.5 | 9.9 | 13.1 | 7.6 | 9.1 | 8.0 | 9.0 | 10.1 | 11.3 | 7.6 | 9.0 | 7.6 | 5.4 | 7.6 | 7.6 | 5.7 | 6.5 | 6.1 |
| ASTM D4683 HTHS Viscosity, cP | 2.7 | 3.0 | 3.3 | 2.6 | 2.7 | 3.0 | 2.6 | 2.9 | 3.0 | 2.4 | 2.6 | 2.5 | 2.2 | 2.2 | 2.3 | 2.2 | 2.3 | 2.3 |
| ASTM D5293 CCS Viscosity @-35 °C, cP | 7195 | 8829 | 10811 | 3246 | 4114 | 5215 | 2822 | 3598 | 4587 | 5432 | 5818 | 6287 | 2348 | 2831 | 2729 | 2025 | 2187 | 2362 |
| Mg, ppm | 1820 | 1820 | 1820 | 1820 | 1820 | 1820 | 1820 | 1820 | 1820 | 1820 | 1820 | 1820 | 1820 | 1820 | 1820 | 1820 | 1820 | 1820 |
| Ca, ppm | 0 | 0 | 0 | 0 | 0 | 0 | 0 | 0 | 0 | 0 | 0 | 0 | 0 | 0 | 0 | 0 | 0 | 0 |
| B, ppm | 501 | 751 | 1001 | 501 | 751 | 1001 | 501 | 751 | 1001 | 500 | 750 | 1000 | 500 | 750 | 1000 | 500 | 750 | 1000 |
| Zn, ppm | 831 | 831 | 831 | 831 | 831 | 831 | 831 | 831 | 831 | 831 | 831 | 831 | 831 | 831 | 831 | 831 | 831 | 831 |
| P, ppm | 761 | 761 | 761 | 761 | 761 | 761 | 761 | 761 | 761 | 761 | 761 | 761 | 761 | 761 | 761 | 761 | 761 | 761 |
| Mo, ppm | 158 | 158 | 158 | 158 | 158 | 158 | 158 | 158 | 158 | 158 | 158 | 158 | 158 | 158 | 158 | 158 | 158 | 158 |
| S, ppm | 1961 | 1961 | 1961 | 1961 | 1961 | 1961 | 1961 | 1961 | 1961 | 1961 | 1961 | 1961 | 1961 | 1961 | 1961 | 1961 | 1961 | 1961 |
| N, ppm | 1420 | 1931 | 2441 | 1429 | 1931 | 2441 | 1420 | 1931 | 2441 | 652 | 778 | 904 | 652 | 778 | 904 | 652 | 778 | 904 |
| Detergent Soap, wt% | 0.52 | 0.52 | 0.52 | 0.52 | 0.52 | 0.52 | 0.52 | 0.52 | 0.52 | 0.52 | 0.52 | 0.52 | 0.52 | 0.52 | 0.52 | 0.52 | 0.52 | 0.52 |
| ASTM D2896 Total Base Number, mgKOH/g | 11.1 | 11.9 | 12.7 | 11.1 | 11.9 | 12.7 | 11.1 | 11.9 | 12.7 | 9.9 | 10.1 | 10.4 | 9.9 | 10.1 | 10.4 | 9.9 | 10.1 | 10.4 |
| ASTM D4739 Total Base Number, mgKOH/g | 9.1 | 9.5 | 10.0 | 9.1 | 9.5 | 10.0 | 9.1 | 9.5 | 10.0 | 8.5 | 8.7 | 8.9 | 8.5 | 8.7 | 8.9 | 8.5 | 8.7 | 8.9 |
| ASTM D874 Sulfated Ash, wt% | 1.2 | 1.3 | 1.4 | 1.2 | 1.3 | 1.4 | 1.2 | 1.3 | 1.4 | 1.2 | 1.3 | 1.4 | 1.2 | 1.3 | 1.4 | 1.2 | 1.3 | 1.4 |
| B/N | 0.4 | 0.4 | 0.4 | 0.4 | 0.4 | 0.4 | 0.4 | 0.4 | 0.4 | 0.8 | 1.0 | 1.1 | 0.8 | 1.0 | 1.1 | 0.8 | 1.0 | 1.1 |
| CEC L-109 -14 FTIR Oxidation @ 216h, A/cm | 53.0 | 71.3 | 40.5 | 63.2 | 41.6 | 50.7 | 36.8 | 33.8 | 31.7 | 80.7 | 48.8 | 76.9 | 90.6 | 34.6 | 37.5 | 67.8 | 67.6 | 56.1 |
| CEC L-109-14 Rel. KV100 Increase 100 °C at 216 hours, % | 338.8 | 231.7 | 65.0 | 942.8 | 106.4 | 110.0 | 132.9 | 75.1 | 48.3 | 3.5 | 5.0 | 31.5 | 24.0 | 8.9 | 23.5 | 11.1 | 59.6 | 95.1 |

LUBRICATING OIL COMPOSITIONS AND METHODS OF USE THEREOF

CROSS-REFERENCE TO RELATED APPLICATIONS

This application claims priority to U.S. Provisional Application Ser. No. 62/461,428 filed Feb. 21, 2017, which is herein incorporated by reference in its entirety.

FIELD

This disclosure relates to lubricant compositions having a combination of detergent, dispersant and/or antioxidant compounds that are highly effective at improving cleanliness and control of high temperature deposits, while also improving or maintaining oxidation stability and viscosity control performance in gasoline and diesel engines. This disclosure also relates to a method for improving oxidation stability and viscosity control, while maintaining or improving cleanliness performance and deposit control, in an engine or other mechanical component lubricated with the lubricant composition. The lubricant compositions of this disclosure are useful as lubricating oils in internal combustion engines or other mechanical components lubricated with the lubricant composition.

BACKGROUND

Lubricant-related performance characteristics such as high temperature deposit control, high temperature viscosity control, and oxidation control are extremely advantageous attributes as measured by a variety of bench and engine tests.

Lubricant-related viscosity and oxidation control performance is highly desirable due to the onset of smaller and higher output modern engine designs. These smaller, higher output, higher efficiency engines are emerging in new vehicle designs as a result of increasingly stringent governmental regulations for vehicle fuel consumption and carbon emissions. Lubricants need to provide a substantial level of high-temperature deposit and cleanliness performance while maintaining good viscosity and oxidation control due to the onset of smaller and higher output modern engine designs.

It is known that some metals (e.g., Fe or Cu) may catalyze oxidation reactions that negatively impact viscosity control in a lubricant. Furthermore, metal-containing detergents (e.g., Na, Ca, and Mg) are often added to a lubricant formulation to provide cleanliness performance, as well as serve as an alkalinity reserve to neutralize acidic oxidation products in the lubricant. Without sufficient levels of metal-containing detergents, high temperature performance issues may arise such as piston deposits, ring sticking and general valve train deposits and sludge. Conversely, an increase in metal-catalyzed oxidation reactions and decrease in viscosity control can be undesirable consequences of higher levels of detergent in an engine oil formulation.

Therefore, a major challenge in engine oil formulation is simultaneously achieving high temperature deposit control and cleanliness, while also controlling metal-catalyzed viscosity increases and oxidation.

Despite advances in lubricant oil formulation technology, there exists a need for an engine oil lubricant that effectively improves oxidation stability and viscosity control while maintaining or improving cleanliness performance and deposit control. In addition, there exists a need for an engine oil lubricant that effectively improves oxidation stability and viscosity control while maintaining or improving cleanliness performance, deposit control and fuel efficiency.

SUMMARY

This disclosure provides lubricant compositions having a unique combination of detergent, dispersant and/or antioxidant compounds that are highly effective at improving cleanliness and control of high temperature deposits, while also improving or maintaining oxidation stability and viscosity control performance in gasoline and diesel engines. In particular, this disclosure provides cleanliness and viscosity control for a lubricant diluted with some amount of biodiesel as well as gasoline fueled engine applications.

This disclosure relates in part to a method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and a mixture of (i) at least one detergent, and (ii) at least one antioxidant, as minor components; wherein the at least one detergent comprises a sulfonate detergent; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one sulfonate detergent, and (ii) at least one alkylated diphenylamine antioxidant. In an embodiment, the engine or other mechanical component is lubricated with the lubricating oil operating in the presence of biodiesel fuel.

This disclosure also relates in part to a lubricating oil having a composition comprising a lubricating oil base stock as a major component; and a mixture of (i) at least one detergent, and (ii) at least one antioxidant, as minor components; wherein the at least one detergent comprises a sulfonate detergent; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one sulfonate detergent, and (ii) at least one alkylated diphenylamine antioxidant. In an embodiment, an engine or other mechanical component is lubricated with the lubricating oil operating in the presence of biodiesel fuel.

This disclosure further relates in part to a method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and a mixture of (i) at least one detergent, and (ii) at least one antioxidant, as minor components; wherein the at least one detergent comprises a calcium-containing detergent; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium-containing detergent, and (ii) at least one alkylated diphenylamine antioxidant. In an embodiment, the engine or other mechanical component is lubricated with the lubricating oil operating in the presence of biodiesel fuel.

This disclosure yet further relates in part to a lubricating oil having a composition comprising a lubricating oil base stock as a major component; and a mixture of (i) at least one detergent, and (ii) at least one antioxidant, as minor components; wherein the at least one detergent comprises a calcium-containing detergent; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium-containing detergent, and (ii) at least one alkylated diphenylamine antioxidant. In an embodiment, an engine or other mechanical component is lubricated with the lubricating oil operating in the presence of biodiesel fuel.

This disclosure also relates in part to a method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and a mixture of (i) at least one detergent, and (ii) at least one antioxidant, as minor components; wherein the at least one detergent comprises a calcium sulfonate detergent; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium sulfonate detergent, and (ii) at least one alkylated diphenylamine antioxidant. In an embodiment, the engine or other mechanical component is lubricated with the lubricating oil operating in the presence of biodiesel fuel.

This disclosure further relates in part to a lubricating oil having a composition comprising a lubricating oil base stock as a major component; and a mixture of (i) at least one detergent, and (ii) at least one antioxidant, as minor components; wherein the at least one detergent comprises a calcium sulfonate detergent; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium sulfonate detergent, and (ii) at least one alkylated diphenylamine antioxidant. In an embodiment, an engine or other mechanical component is lubricated with the lubricating oil operating in the presence of biodiesel fuel.

This disclosure yet further relates in part to a method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and at least one detergent, as a minor component; wherein the at least one detergent comprises a calcium sulfonate detergent; and wherein oxidation stability and viscosity control are improved and cleanliness performance and deposit control are maintained or improved as compared to oxidation stability, viscosity control, cleanliness performance and deposit control achieved using a lubricating oil containing a minor components other than the at least one calcium sulfonate detergent. In an embodiment, the engine or other mechanical component is lubricated with the lubricating oil operating in the presence of biodiesel fuel.

This disclosure also relates in part to a lubricating oil having a composition comprising a lubricating oil base stock as a major component; and at least one detergent, as a minor component; wherein the at least one detergent comprises a calcium sulfonate detergent; and wherein oxidation stability and viscosity control are improved and cleanliness performance and deposit control are maintained or improved as compared to oxidation stability, viscosity control, cleanliness performance and deposit control achieved using a lubricating oil containing a minor component other than the at least one calcium sulfonate detergent. In an embodiment, an engine or other mechanical component is lubricated with the lubricating oil operating in the presence of biodiesel fuel.

This disclosure further relates in part to a method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant that provides a boron concentration from about 10 to about 1500 parts per million in said formulated oil; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant. In an embodiment, the engine or other mechanical component is lubricated with the lubricating oil operating in the presence of biodiesel fuel.

This disclosure yet further relates in part to a lubricating oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant that provides a boron concentration from about 10 to about 1500 parts per million in said formulated oil; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant. In an embodiment, an engine or other mechanical component is lubricated with the lubricating oil operating in the presence of biodiesel fuel.

It has been surprisingly found that, in accordance with this disclosure, improvements in oxidation stability and viscosity control are obtained while maintaining or improving cleanliness performance and deposit control in an engine or other mechanical component lubricated with a lubricating oil in the presence of biodiesel fuel, by including a mixture of (i) at least one sulfonate detergent, and (ii) at least one alkylated diphenylamine antioxidant and optionally at least one hindered phenol ester antioxidant, in the lubricating oil.

Further, it has been surprisingly found that, in accordance with this disclosure, improvements in oxidation stability and viscosity control are obtained while maintaining or improving cleanliness performance and deposit control in an engine or other mechanical component lubricated with a lubricating oil in the presence of biodiesel fuel, by including a mixture of (i) at least one calcium-containing detergent, and (ii) at least one alkylated diphenylamine antioxidant and optionally at least one hindered phenol ester antioxidant, in the lubricating oil.

Yet further, it has been surprisingly found that, in accordance with this disclosure, improvements in oxidation stability and viscosity control are obtained while maintaining or improving cleanliness performance and deposit control in an engine or other mechanical component lubricated with a lubricating oil in the presence of biodiesel fuel, by including a mixture of (i) at least one calcium sulfonate detergent, and (ii) at least one alkylated diphenylamine antioxidant and optionally at least one hindered phenol ester antioxidant, in the lubricating oil.

Also, it has been surprisingly found that, in accordance with this disclosure, improvements in oxidation stability and viscosity control are obtained while maintaining or improving cleanliness performance and deposit control in an engine or other mechanical component lubricated with a lubricating oil in the presence of biodiesel fuel, by including at least one calcium sulfonate detergent, in the lubricating oil.

Further, it has been surprisingly found that, in accordance with this disclosure, improvements in oxidation stability and viscosity control are obtained while maintaining or improving cleanliness performance and deposit control in an engine or other mechanical component lubricated with a lubricating oil in the presence of biodiesel fuel, by including a mixture of (i) at least one magnesium-containing detergent, (ii) at least one borated dispersant, and (iii) at least one alkylated diphenylamine antioxidant and optionally at least one hindered phenol ester antioxidant, in the lubricating oil.

Other objects and advantages of the present disclosure will become apparent from the detailed description that follows.

BRIEF DESCRIPTION OF THE DRAWINGS

FIG. 1 shows tabulated results of extended CEC L-109-14 oxidation tests which demonstrate aspects of the disclosure related to antioxidant and detergent type choice.

FIG. 2 shows tabulated results of extended CEC L-109-14 oxidation tests which demonstrate aspects of the disclosure related to antioxidant and detergent type choice.

FIG. 3 shows tabulated results of extended CEC L-109-14 oxidation tests which demonstrate the impact of detergent concentration on viscosity and oxidation control.

FIG. 4 shows results from Sequence IIIG (ASTM D7320) engine tests which show the impacts of removing detergent and antioxidant on the cleanliness and viscosity control performance.

FIG. 5 shows tabulated results from CEC L-109-14 oxidation tests which demonstrate aspects of the disclosure related to synergy between antioxidant, detergent, and dispersant selection.

FIG. 6 shows tabulated results from CEC L-109-14 oxidation tests which demonstrate aspects of the disclosure related to synergy between antioxidant, detergent, and dispersant selection.

FIG. 7 shows tabulated results from CEC L-109-14 oxidation tests which demonstrate aspects of the disclosure related to antioxidant, detergent, and dispersant selection across a broad range of compositions.

FIG. 8 shows tabulated results from CEC L-109-14 oxidation tests which demonstrate aspects of the disclosure related to antioxidant, detergent, and dispersant selection across a broad range of compositions.

FIG. 9 shows tabulated results from CEC L-109-14 oxidation tests which demonstrate aspects of the disclosure related to antioxidant, detergent, and dispersant selection across a broad range of compositions.

FIG. 10 shows tabulated results from CEC L-109-14 oxidation tests which demonstrate aspects of the disclosure related to the antioxidant, detergent, dispersant, and base stock selection.

DETAILED DESCRIPTION

All numerical values within the detailed description and the claims herein are modified by "about" or "approximately" the indicated value, and take into account experimental error and variations that would be expected by a person having ordinary skill in the art.

The lubricating oils of this disclosure can be useful as commercial vehicle engine oil products (e.g., heavy duty diesel lubricants) as well as light duty diesel passenger vehicle lubricants. Furthermore the lubricating oils of this disclosure can be useful in lubricating internal combustion engines fueled from a variety of sources (e.g., gasoline, diesel, biofuels including biodiesel and biomass derived fuels, fuels derived from renewable sources, as well as natural gas including liquefied petroleum gas and compressed natural gas). In particular, the lubricating oils of this disclosure can be useful for improving oxidation stability and viscosity control, while maintaining or improving cleanliness performance and deposit control in lubricating engine oils.

The lubricating oils of this disclosure provide excellent engine protection including lubricant oxidation stability and viscosity control, while maintaining or improving cleanliness and deposit control.

The present disclosure provides lubricant compositions with excellent oxidation stability and viscosity control properties.

The lubricant compositions of this disclosure provide advantaged oxidation stability and viscosity control, including cleanliness and deposit control, performance in the lubrication of internal combustion engines, power trains, drivelines, transmissions, gears, gear trains, gear sets, compressors, pumps, hydraulic systems, bearings, bushings, turbines, and the like.

Also, the lubricant compositions of this disclosure provide advantaged oxidation stability and viscosity control, including cleanliness and deposit control, performance in the lubrication of mechanical components, which can include, for example, pistons, piston rings, cylinder liners, cylinders, cams, tappets, lifters, bearings (journal, roller, tapered, needle, ball, and the like), gears, valves, and the like.

Further, the lubricant compositions of this disclosure provide advantaged oxidation stability and viscosity control, including cleanliness and deposit control, performance as a component in lubricant compositions, which can include, for example, lubricating liquids, semi-solids, solids, greases, dispersions, suspensions, material concentrates, additive concentrates, and the like.

The lubricant compositions of this disclosure are useful in additive concentrates that include the minor component of this disclosure with at least one other additive component, having combined weight % concentrations in the range of 1% to 80%, preferably 1% to 60%, more preferably 1% to 50%, even more preferably 1% to 40%, and in some instances preferably 1% to 30%. Under some circumstances, the combined weight % concentrations cited above may be in the range of 1% to 20%, and preferably 1% to 10%.

Yet further, the lubricant compositions of this disclosure provide advantaged oxidation stability and viscosity control, including cleanliness and deposit control, performance under diverse lubrication regimes, that include, for example, hydrodynamic, elastohydrodynamic, boundary, mixed lubrication, extreme pressure regimes, and the like.

The lubricant compositions of this disclosure provide advantaged oxidation stability and viscosity control, including cleanliness and deposit control, performance under a range of lubrication contact pressures, less than 1 MPa, and from 1 MPas to greater than 10 GPa, preferably greater than 10 MPa, more preferably greater than 100 MPa, even more preferably greater than 300 MPa. Under certain circumstances, the lubricant compositions of this disclosure provide advantaged oxidation stability and viscosity control, including cleanliness and deposit control, performance at greater than 0.5 GPa, often at greater than 1 GPa, sometimes greater than 2 GPa, under selected circumstances greater than 5 GPa.

Also, the lubricant compositions of this disclosure provide advantaged oxidation stability and viscosity control, including cleanliness and deposit control, performance in spark-ignition internal combustion engines, compression-ignition internal combustion engines, mixed-ignition (spark-assisted and compression) internal combustion engines, jet- or plasma-ignition internal combustion engines, and the like.

Further, the lubricant compositions of this disclosure provide advantaged oxidation stability and viscosity control, including cleanliness and deposit control, performance in diverse engine and power plant types, which can include, for example, the following: 2-stroke engines; 4-stroke engine; engines with alternate stroke designs greater than 2-stroke, such as 5-stroke, or 7-stroke, and the like; rotary engines; dedicated EGR (exhaust gas recirculation) fueled engines; free-piston type engines; opposable-piston opposable-cylinder type engines; engines that function in hybrid propulsion systems, that can further include electrical-based power systems, hydraulic-based power systems, diverse system designs such as parallel, series, non-parallel, and the like.

Yet further, the lubricant compositions of this disclosure provide advantaged oxidation stability and viscosity control, including cleanliness and deposit control, performance in, for example, the following: naturally aspirated engines; turbocharged and supercharged, port-fueled injection engines; turbocharged and supercharged, direct injection engines (for gasoline, diesel, natural gas, mixtures of these, and other fuel types); turbocharged engines designed to operate with in-cylinder combustion pressures of greater than 12 bar, preferably greater than 18 bar, more preferably greater than 20 bar, even more preferably greater than 22 bar, and in certain instances combustion pressures greater than 24 bar, even greater than 26 bar, and even more so greater than 28 bar, and with particular designs greater than 30 bar; engines having low-temperature burn combustion, lean-burn combustion, and high thermal efficiency designs.

Also, the lubricant compositions of this disclosure provide advantaged oxidation stability and viscosity control, including cleanliness and deposit control, performance in engines that are fueled with fuel compositions that include, for example, the following: gasoline; distillate fuel, diesel fuel, biodiesel fuel, jet fuel, gas-to-liquid and Fischer-Tropsch-derived high-cetane fuels; compressed natural gas, liquefied natural gas, methane, ethane, propane, other natural gas components, other natural gas liquids; ethanol, methanol, other higher MW alcohols; FAMEs, vegetable-derived esters and polyesters; biodiesel, bio-derived and bio-based fuels; hydrogen; dimethyl ether; other alternate fuels; fuels diluted with EGR (exhaust gas recirculation) gases, with EGR gases enriched in hydrogen or carbon monoxide or combinations of $H_2/CO$, in both dilute and high concentration (in concentrations of >0.1%, preferably >0.5%, more preferably >1%, even more preferably >2%, and even more so preferably >3%), and blends or combinations of these in proportions that enhance combustion efficiency, power, cleanliness, anti-knock, and anti-LSPI (low speed pre-ignition).

Further, the lubricant compositions of this disclosure provide advantaged oxidation stability and viscosity control, including cleanliness and deposit control, performance on lubricated surfaces that include, for example, the following: metals, metal alloys, non-metals, non-metal alloys, mixed carbon-metal composites and alloys, mixed carbon-non-metal composites and alloys, ferrous metals, ferrous composites and alloys, non-ferrous metals, non-ferrous composites and alloys, titanium, titanium composites and alloys, aluminum, aluminum composites and alloys, magnesium, magnesium composites and alloys, ion-implanted metals and alloys, plasma modified surfaces; surface modified materials; coatings; mono-layer, multi-layer, and gradient layered coatings; honed surfaces; polished surfaces; etched surfaces; textured surfaces; micro and nano structures on textured surfaces; super-finished surfaces; diamond-like carbon (DLC), DLC with high-hydrogen content, DLC with moderate hydrogen content, DLC with low-hydrogen content, DLC with near-zero hydrogen content, DLC composites, DLC-metal compositions and composites, DLC-non-metal compositions and composites; ceramics, ceramic oxides, ceramic nitrides, FeN, CrN, ceramic carbides, mixed ceramic compositions, and the like; polymers, thermoplastic polymers, engineered polymers, polymer blends, polymer alloys, polymer composites; materials compositions and composites containing dry lubricants, that include, for example, graphite, carbon, molybdenum, molybdenum disulfide, polytetrafluoroethylene, polyperfluoropropylene, polyperfluoroalkylethers, and the like.

Yet further, the lubricant compositions of this disclosure provide advantaged oxidation stability and viscosity control, including cleanliness and deposit control, performance on lubricated surfaces of 3-D printed materials, and similar materials derived from additive manufacturing techniques, with or without post-printing surface finishing; surfaces of 3-D printed materials that have been post-printing treated with coatings, which may include plasma spray coatings, ion beam-generated coatings, electrolytically- or galvanically-generated coatings, electro-deposition coatings, vapor-deposition coatings, liquid-deposition coatings, thermal coatings, laser-based coatings; surfaces of 3-D printed materials, where the surfaces may be as-printed, finished, or coated, that include: metals, metal alloys, non-metals, non-metal alloys, mixed carbon-metal composites and alloys, mixed carbon-nonmetal composites and alloys, ferrous metals, ferrous composites and alloys, non-ferrous metals, non-ferrous composites and alloys, titanium, titanium composites and alloys, aluminum, aluminum composites and alloys, magnesium, magnesium composites and alloys, ion-implanted metals and alloys; plasma modified surfaces; surface modified materials; mono-layer, multi-layer, and gradient layered coatings; honed surfaces; polished surfaces; etched surfaces; textured surfaces; mircro and nano structures on textured surfaces; super-finished surfaces; diamond-like carbon (DLC), DLC with high-hydrogen content, DLC with moderate hydrogen content, DLC with low-hydrogen content, DLC with near-zero hydrogen content, DLC composites, DLC-metal compositions and composites, DLC-non-metal compositions and composites; ceramics, ceramic oxides, ceramic nitrides, FeN, CrN, ceramic carbides, mixed ceramic compositions, and the like; polymers, thermoplastic polymers, engineered polymers, polymer blends, polymer alloys, polymer composites; materials compositions and composites containing dry lubricants, that include, for example, graphite, carbon, molybdenum, molybdenum disulfide, polytetrafluoroethylene, polyperfluoropropylene, polyperfluoroalkylethers, and the like.

This disclosure relates in part to new lubricating oil formulations which are particularly useful in high compression spark ignition engines and, when used in high compression spark ignition engines, will prevent or minimize engine knocking and pre-ignition problems. The lubricating oil compositions of this disclosure are useful in high compression spark ignition engines, including gasoline-fueled, and natural gas, liquefied petroleum gas, dimethyl ether-fueled spark ignition engines, or any spark ignition engine operating under a fuel from a renewable source (e.g., biodiesel). The lubricant formulation chemistry of this disclosure can be used to prevent or control the detrimental effect of engine knocking and pre-ignition in engines which have already been designed or sold in the marketplace as well as future engine technology. The lubricant formulation solutions afforded by this disclosure for preventing or reducing engine knocking and pre-ignition problems enables product differentiation with regard to the engine knocking and pre-ignition problems.

The lubricant compositions in this disclosure, in addition to providing enhanced oxidation resistance and viscosity control when contaminated with biodiesel, may also be useful in reducing or eliminating engine knock or pre-ignition. Examples of engine knock or pre-ignition include low speed pre-ignition (LSPI) and other abnormal combustion events which can occur in both spark-ignition and compression-ignition engines. Engine types which may benefit from reduced abnormal combustion (including LSPI, engine knock, and other abnormal combustion events) include turbocharged gasoline direct injection engines (TGDI) and other spark ignition engines capable of high brake mean effective pressures (>10 bar) at low to moderate engine speeds (1500-3000 RPM), as well as engines based on non-conventional combustion schemes such as homogeneous charge compression ignition (HCCI), reactively controlled compression ignition (RCCI), or premixed charged compression ignition (PCCI). Such engines could range in displacement from 1 liter to 60 liters and may possess from 1 to 12 combustion cylinders configured in one of several geometries including in-line, "V", and boxer or "flat" configurations. Such engines may be so-called "dual-fuel" where a secondary fuel such as gasoline or natural gas (such as compressed natural gas or liquefied natural gas) is used in combination with diesel or biodiesel.

Still further, the lubricant compositions of this disclosure provide advantaged synergistic oxidation stability and viscosity control, including cleanliness and deposit control, performance in combination with one or more performance additives, with performance additives at effective concentration ranges, and with performance additives at effective ratios with the minor component of this disclosure.

The present disclosure has been described above with reference to numerous embodiments. Many variations will suggest themselves to those skilled in this art in light of the above detailed description. All such obvious variations are within the full intended scope of the appended claims, including the following embodiments.

In an embodiment, this disclosure relates in part to a method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant having a boron:nitrogen (B/N) ratio from about 0.1 to about 2; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant.

In another embodiment, this disclosure relates in part to a lubricating oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant having a boron:nitrogen (B/N) ratio from about 0.1 to about 2; wherein the at least one antioxidant comprises an alkylated diphenylamine; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant.

In yet another embodiment, this disclosure relates in part to a method for preventing or reducing engine knock or pre-ignition in a high compression spark ignition engine lubricated with a lubricating oil by using as the lubricating oil a formulated oil, said formulated oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant that provides a boron concentration from about 10 to about 1500 parts per million in said formulated oil; and wherein the at least one antioxidant comprises an alkylated diphenylamine.

In still another embodiment, this disclosure relates in part to a lubricating oil useful for preventing or reducing engine knock or pre-ignition in a high compression spark ignition engine, said lubricating oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant that provides a boron concentration from about 10 to about 1500 parts per million in said formulated oil; and wherein the at least one antioxidant comprises an alkylated diphenylamine.

In another embodiment, this disclosure relates in part to a method for preventing or reducing engine knock or pre-ignition in a high compression spark ignition engine lubricated with a lubricating oil by using as the lubricating oil a formulated oil, said formulated oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant having a boron: nitrogen (B/N) ratio from about 0.1 to about 2; and wherein the at least one antioxidant comprises an alkylated diphenylamine.

In yet another embodiment, this disclosure relates in part to a lubricating oil useful for preventing or reducing engine knock or pre-ignition in a high compression spark ignition engine, said lubricating oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant having a boron: nitrogen (B/N) ratio from about 0.1 to about 2; and wherein the at least one antioxidant comprises an alkylated diphenylamine.

Lubricating Oil Base Stocks and Co-Base Stocks

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins.

However, the dimers of higher olefins in the range of $C_{12}$ to $C_{18}$ may be used to provide low viscosity base stocks of acceptably low volatility. Depending on the viscosity grade and the starting oligomer, the PAOs may be predominantly dimers, trimers and tetramers of the starting olefins, with minor amounts of the lower and/or higher oligomers, having a viscosity range of 1.5 cSt to 12 cSt. PAO fluids of particular use may include 3 cSt, 3.4 cSt, and/or 3.6 cSt and combinations thereof. Mixtures of PAO fluids having a viscosity range of 1.5 cSt to approximately 150 cSt or more may be used if desired. Unless indicated otherwise, all viscosities cited herein are measured at 100° C.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 2 cSt to about 50 cSt, preferably about 2 cSt to about 30 cSt, more preferably about 3 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl biphenyls, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 2 cSt to about 50 cSt are preferred, with viscosities of approximately 3 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Alkylated naphthalene and analogues may also comprise compositions with isomeric distribution of alkylating groups on the alpha and beta carbon positions of the ring structure. Distribution of groups on the alpha and beta positions of a naphthalene ring may range from 100:1 to 1:100, more often 50:1 to 1:50 Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorus and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from about 6 to about 99 weight percent or from about 6 to about 95 weight percent, preferably from about 50 to about 99 weight percent or from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 18 cSt (or $mm^2/s$) at 100° C. and preferably of about 2.5 cSt to about 12.5 cSt (or $mm^2/s$) at 100° C., often more preferably from about 2.5 cSt to about 10 cSt. Mixtures of synthetic and natural base oils may be used if desired. Bi-modal, tri-modal, and additional combinations of mixtures of Group I, II, III, IV, and/or V base stocks may be used if desired.

The co-base stock component is present in an amount sufficient for providing solubility, compatibility and dispersancy of polar additives in the lubricating oil. The co-base stock component is present in the lubricating oils of this disclosure in an amount from about 1 to about 99 weight percent, preferably from about 5 to about 95 weight percent, and more preferably from about 10 to about 90 weight percent.

Detergent Additives

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur-containing acid, carboxylic acid (e.g., salicylic acid), phosphorus-containing acid, phenol, or mixtures thereof. The counterion is typically an alkaline earth or alkali metal. The detergent can be overbased as described herein.

The detergent is preferably a metal salt of an organic or inorganic acid, a metal salt of a phenol, or mixtures thereof. The metal is preferably selected from an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal is preferably selected from an alkali metal, an alkaline earth metal, and mixtures thereof. More preferably, the metal is selected from calcium (Ca), magnesium (Mg), and mixtures thereof.

The organic acid or inorganic acid is preferably selected from a sulfur-containing acid, a carboxylic acid, a phosphorus-containing acid, and mixtures thereof.

Preferably, the metal salt of an organic or inorganic acid or the metal salt of a phenol comprises calcium sulfonate, calcium phenate, calcium salicylate, magnesium sulfonate, magnesium phenate, magnesium salicylate, an overbased detergent, and mixtures thereof.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Preferably the TBN delivered by the detergent is between 1 and 20. More preferably between 1 and 12. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

As measured by ASTM D2896, TBN can range from about 0 to about 12 mgKOH/g, or from about 1 to about 11 mgKOH/g, or from about 2 to about 10 mgKOH/g, or from about 2.5 to about 10 mgKOH/g.

As measured by ASTM D4739, TBN can range from about 0 to about 11 mgKOH/g, or from about 1 to about 10 mgKOH/g, or from about 2 to about 9.5 mgKOH/g.

Alkaline earth phenates are another useful class of detergent. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are illustrative detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

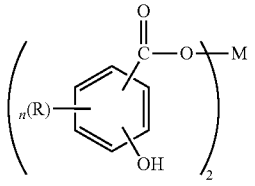

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, barium, or mixtures thereof. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium sulfonates, magnesium sulfonates, calcium salicylates, magnesium salicylates, calcium phenates, magnesium phenates, and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate. Overbased detergents are also preferred.

Reducing or eliminating sulfated ash bearing detergents contributes to improved oxidation and viscosity control; however, formulating lubricants without sufficient detergent can have significant impacts which compromise viscosity control and oxidation in other ways. The amount of sulfated ash in the lubricating oils of this disclosure can vary from about 0.1 to about 1.6 wt %, or from about 0.3 to about 1.2 wt %, or from about 0.3 to about 1 wt %, or from about 0.4 to about 0.9 wt %.

The calcium-containing detergents useful in this disclosure provide a calcium concentration from about 500 parts per million to about 5000 parts per million, or from about 500 parts per million to about 3000 parts per million, or from about 500 parts per million to about 2500 parts per million, or from about 500 parts per million to about 2200 parts per million, or from about 500 parts per million to about 1800 parts per million, in the formulated oil.

The magnesium-containing detergents useful in this disclosure provide a magnesium concentration from about 500 parts per million to about 5000 parts per million, or from about 500 parts per million to about 3000 parts per million, or from about 500 parts per million to about 2500 parts per million, or from about 500 parts per million to about 2200 parts per million, or from about 500 parts per million to about 1800 parts per million, in the formulated oil.

The weight ratio of the at least one detergent to the at least one antioxidant is from about 0.1:1 to about 1000:1. The weight ratio of the at least one detergent to the at least one dispersant is from about 0.1:1 to about 1000:1.

The detergent concentration in the lubricating oils of this disclosure can range from about 0.5 to about 6.0 weight percent, preferably about 0.6 to 5.0 weight percent, and more preferably from about 0.8 weight percent to about 4.0 weight percent, based on the total weight of the lubricating oil.

For a sulfonate or mix with salicylate or phenate detergent, the detergent concentration in the lubricating oils of this disclosure can range from about 0 to about 2 weight percent, or from about 0.1 to 1.6 weight percent, or from about 0.1 weight percent to about 1.2 weight percent, or from about 0.1 weight percent to about 1 weight percent, based on the total weight of the lubricating oil. For a sulfonate detergent or a mixture of sulfonate with salicylate or phenate detergents, the total detergent soap contributed to the formulated oil by the sulfonate detergent or mixture of sulfonate and salicylate and/or phenate detergents can range from about 0 to about 2 wt %, or from about 0.1 to 1.6 wt %, or from about 0.1 to 1.2 wt %, or more preferably from about 0.1 to about 1.0 wt %.

For a 300 TBN calcium sulfonate detergent, the detergent concentration in the lubricating oils of this disclosure can range from about 0 to about 5 weight percent, or about 0 to 3 weight percent, or from about 0.3 weight percent to about 2.5 weight percent, or from about 0.4 weight percent to about 2.4 weight percent, based on the total weight of the lubricating oil.

For a 400 TBN magnesium sulfonate detergent, the detergent concentration in the lubricating oils of this disclosure can range from about 0 to about 5 weight percent, or about 0 to 3 weight percent, or from about 0.3 weight percent to about 2.5 weight percent, or from about 0.4 weight percent to about 2.4 weight percent, based on the total weight of the lubricating oil.

For a 8 TBN calcium sulfonate detergent, the detergent concentration in the lubricating oils of this disclosure can range from about 0 to about 2 weight percent, or about 0 to 1.5 weight percent, or from about 0.2 weight percent to about 1 weight percent, or from about 0.3 weight percent to about 0.8 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Borated Dispersant Additives

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the borated (poly)alkenylsuccinic derivatives, typically produced by the reaction of a long chain hydrocarbyl substituted succinic compound, usually a hydrocarbyl substituted succinic anhydride, with a polyhydroxy or polyamino compound, and post reacted with a boron compound such as boric acid, borate esters or highly borated dispersants. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Borated hydrocarbyl-substituted succinic acid and borated hydrocarbyl-substituted succinic anhydride derivatives are useful dispersants. In particular, borated succinimide, borated succinate esters, or borated succinate ester amides prepared by the reaction of a hydrocarbon-substituted succinic acid compound preferably having at least 50 carbon atoms in the hydrocarbon substituent, with at least one equivalent of an alkylene amine, and post reacted with a boron compound such as boric acid, borate esters or highly borated dispersants, are particularly useful.

Borated succinimides are formed by the condensation reaction between hydrocarbyl substituted succinic anhydrides and amines, and post reacted with a boron compound such as boric acid, borate esters or highly borated dispersants. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Borated succinate esters are formed by the condensation reaction between hydrocarbyl substituted succinic anhydrides and alcohols or polyols, and post reacted with a boron compound such as boric acid, borate esters or highly borated dispersants. Molar ratios can vary depending on the alcohol or polyol used. For example, the condensation product of a hydrocarbyl substituted succinic anhydride and pentaerythritol is a useful dispersant.

Borated succinate ester amides are formed by condensation reaction between hydrocarbyl substituted succinic anhydrides and alkanol amines, and post reacted with a boron compound such as boric acid, borate esters or highly borated dispersants. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the borated hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Borated Mannich base dispersants are made from the reaction of alkylphenols, formaldehyde, and amines, and post reacted with a boron compound such as boric acid, borate esters or highly borated dispersants. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight borated aliphatic acid modified Mannich condensation products useful in this disclosure can be prepared from high molecular weight alkyl-substituted hydroxyaromatics or $HNR_2$ group-containing reactants, and post reacted with a boron compound such as boric acid, borate esters or highly borated dispersants.

Borated hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred borated dispersants include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred borated dispersants include borated succinic acid-esters and amides, borated alkylphenol-polyamine-coupled Mannich adducts, their capped derivatives, and other related components.

Borated polymethacrylate or polyacrylate derivatives are another class of dispersants. These borated dispersants are typically prepared by reacting a nitrogen containing monomer and a methacrylic or acrylic acid esters containing 5-25 carbon atoms in the ester group, and post reacting with a boron compound such as boric acid, borate esters or highly borated dispersants. Representative examples are shown in U.S. Pat. Nos. 2,100,993, and 6,323,164. Borated polymethacrylate and polyacrylate dispersants are normally used as multifunctional viscosity modifiers. The lower molecular weight versions can be used as lubricant dispersants or fuel detergents.

Illustrative preferred borated dispersants useful in this disclosure include those derived from polyalkenyl-substituted mono- or dicarboxylic acid, anhydride or ester, and post reacted with a boron compound such as boric acid, borate esters or highly borated dispersants, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feed stocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The borated dispersant(s) are preferably non-polymeric (e.g., borated mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such borated dispersants may be used in an amount of about 0.01 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates. Nitrogen content in the finished oil can vary from about 0 parts per million by weight to about 3000 parts per million by weight, or from about 200 parts per million by weight to about 2600 parts per million by weight, or from about 200 parts per million by weight to about 2000 parts per million by weight, or from about 200 parts per million by weight to about 1500 parts per million by weight, or from about 200 parts per million by weight to about 1200 parts per million by weight. Basic nitrogen can vary from about 50 ppm by weight to about 1000 ppm by weight, preferably from about 100 ppm by weight to about 600 ppm by weight.

The borated dispersants useful in this disclosure provide a boron concentration from about 10 to about 1500 parts per million, or from about 50 to about 1000 parts per million, or from about 50 to about 750 parts per million, or from about 50 to about 500 parts per million, or from about 100 to about 500 parts per million, or from about 100 to about 300 parts per million, in the formulated oil.

The borated dispersants useful in this disclosure have a boron:nitrogen (B/N) ratio from about 0.1 to about 2, preferably from about 0.5 to about 2, and more preferably from about 1 to about 2.

Borated dispersants as described herein are beneficially useful with the compositions of this disclosure. Further, in one embodiment, preparation of the compositions of this disclosure using one or more dispersants is achieved by combining ingredients of this disclosure, plus optional base stocks and lubricant additives, in a mixture at a temperature above the melting point of such ingredients, particularly that of the one or more M-carboxylates (M=H, metal, two or more metals, mixtures thereof).

For mid to high B/N borated dispersants, the dispersant concentration in the lubricating oils of this disclosure can range from about 0 to about 8 weight percent, or about 1 to 7 weight percent, or from about 2 weight percent to about 6 weight percent, or from about 2 weight percent to about 5 weight percent, based on the total weight of the lubricating oil.

For total dispersant concentration including mixtures of borated and non borated dispersants, the total dispersant concentration in the lubricating oils of this disclosure can range from about 0 to about 10 weight percent, or about 0 to 8 weight percent, or from about 1 weight percent to about 7 weight percent, or from about 1 weight percent to about 6 weight percent, based on the total weight of the lubricating oil.

The weight ratio of the at least one dispersant to the at least one antioxidant is from about 0.1:1 to about 1000:1. The weight ratio of the at least one dispersant to the at least one detergent is from about 0.1:1 to about 1000:1.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Antioxidant Additives

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where RH is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octyl-phenyl-alpha-naphthylamine.

Sulfurized alkyl phenols and alkali or alkaline earth metal salts thereof also are useful antioxidants.

The weight ratio of the at least one antioxidant to the at least one detergent is from about 0.1:1 to about 1000:1. The weight ratio of the at least one antioxidant to the at least one dispersant is from about 0.1:1 to about 1000:1.

Preferred antioxidants include hindered phenols, arylamines, and the like. These antioxidants may be used individually by type or in combination with one another. Such additives may be used in an amount of about 0.01 to 5 weight percent, preferably about 0.5 to 4 weight percent, or more preferably about 0.5 to about 3.5 weight percent.

Other Additives

The formulated lubricating oil useful in the present disclosure may additionally contain one or more of the other commonly used lubricating oil performance additives including but not limited to other dispersants, other detergents, other antioxidants, viscosity modifiers, antiwear additives, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, defoamants, demulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The additives useful in this disclosure do not have to be soluble in the lubricating oils. Insoluble additives in oil can be dispersed in the lubricating oils of this disclosure.

The types and quantities of performance additives used in combination with the instant disclosure in lubricant compositions are not limited by the examples shown herein as illustrations.

Antiwear Additives

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be propanol, 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from about 0.3 weight percent to about 1.5 weight percent, preferably from about 0.4 weight percent to about 1.2 weight percent, more preferably from about 0.5 weight percent to about 1.0 weight percent, and even more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

Illustrative preferred dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.01 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates. Nitrogen content in the finished oil can vary from about 200 ppm by weight to about 2000 ppm by weight, preferably from about 200 ppm by weight to about 1200 ppm by weight. Basic nitrogen can vary from about 100 ppm by weight to about 1000 ppm by weight, preferably from about 100 ppm by weight to about 600 ppm by weight.

Dispersants as described herein are beneficially useful with the compositions of this disclosure and substitute for some or all of the surfactants of this disclosure. Further, in one embodiment, preparation of the compositions of this disclosure using one or more dispersants is achieved by combining ingredients of this disclosure, plus optional base stocks and lubricant additives, in a mixture at a temperature above the melting point of such ingredients, particularly that of the one or more M-carboxylates (M=H, metal, two or more metals, mixtures thereof).

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941" and or "PARATONE 8900E"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 150".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A-B wherein A is a polymeric block derived predominantly from vinyl aromatic hydrocarbon monomer, and B is a polymeric block derived predominantly from conjugated diene monomer.

In an embodiment of this disclosure, the viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the formulated oil or lubricating engine oil. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.5-3.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1.5 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Formulations were prepared as described herein and the ingredients are set forth in FIGS. 1-10. In particular, formulations were prepared by blending the ingredients into a base stock and/or a co-base stock. All of the ingredients used herein are commercially available. Internal combustion engine oil formulations were prepared as described herein.

The detergents used in the formulations included: a 200 TBN mixture of calcium salicylate detergents with about 27 wt % soap (i.e., Calcium Salicylate Detergent 1); a 64 TBN calcium alkylsalicylate detergent with about 31 wt % soap (i.e., Calcium Salicylate Detergent 2); a 300 TBN overbased calcium sulfonate detergent with about 29 wt % soap (i.e., Calcium Sulfonate Detergent); and a 400 TBN overbased magnesium sulfonate detergent with about 26 wt % soap (i.e., Magnesium Sulfonate Detergent).

The antioxidants used in the formulations included: a mixed alkyl-diphenylamine ashless antioxidant (Aminic AO); 4,4' methylene bis (2-6, di-t-butylphenol) (Phenolic AO 1); a hindered phenolic propionic acid ester of iso-octanol (Phenolic AO 2); and a hindered phenolic propionic acid ester of butanol (Phenolic AO 3).

The dispersants used in the formulations included: an ethylene carbonate treated polyisobutenyl succinimide (Non Borated Dispersant 1); polyisobutenyl bis-succinimide (Non Borated Dispersant 2); polyisobutenyl succinimide (Non Borated Dispersant 3); borated polyisobutenyl succinimide with a B/N of about 0.5 (Low B/N Dispersant); boron-containing polyisobutenyl succinimide/succinic acid with a B/N of about 1 (Mid B/N Dispersant); and boron-containing polyisobutenyl succinimide/succinic acid with a B/N of about 2 (High B/N Dispersant).

The additive package used in the formulations included conventional additives in conventional amounts.

Oxidation testing was conducted for each of the formulations listed in FIGS. 1-3 and 5-10. The oxidation testing results are set forth in FIGS. 1-3 and 5-10. The oxidation testing included: CEC L-109-14 (FIGS. 3 and 5-10) which is an oxidation test for engine oils operating in the presence of biodiesel fuel; and infrared (IR) oxidation (FIGS. 1 and 2) in accordance with ASTM D7414.

Engine testing was conducted for each of the formulations listed in FIG. 4. The testing results are set forth in FIG. 4. The engine testing in FIG. 4 included the following: Sequence IIIG (PVIS kinematic viscosity increase at 40° C., %) measured by ASTM D7320; and Sequence IIIG (WPD average weighted piston deposits, merits) measured by ASTM D7320.

FIGS. 1 and 2 show one aspect of the disclosure which is the synergy between the formulated antioxidant system and the detergent. Comparative examples 1-3 and 11-13 show CEC L-109-14 results for formulations containing no aminic type antioxidant. These results are substantially poorer than any of the inventive examples (Examples 1-7) which do contain aminic antioxidant. The improvement in viscosity control and oxidation control is significant, and can be as high as 800%. Combining an aminic antioxidant with a hindered phenol ester type antioxidant provides further improvement in oxidation and viscosity control as measured in the CEC L-109-14 oxidation test. Examples 1-7 demonstrate the synergy of this formulated AO system as compared with comparative examples 1-3 and 11-13. Preferably the total antioxidant concentration is between 0.5 to 3.9 on a weight percent basis. More preferably the total antioxidant concentration is 0.75-3.5 wt %, or more preferably 0.9-3.0 wt %, or even more preferably 1.3-2.6 wt %.

Additionally, FIGS. 1 and 2 show significant synergy between the formulated antioxidant system and sulfonate detergents. A comparison of Comparative Examples 1-10 with Examples 1-7 shows a significant and unexpected benefit to using sulfonate detergents in combination with the antioxidant system discussed previously. In particular, from FIGS. 1 and 2, it is clear that an aminic type antioxidant contributes to improved viscosity and oxidation control as measured in the CEC L-109-14 oxidation test, while using a formulated antioxidant system comprising aminic and hindered phenol ester antioxidants provides additional benefits when combined with over-based sulfonate detergents. Such detergents could be either calcium or magnesium containing, or mixtures thereof. Preferably the ratio of Ca to Mg is in the range of 0.1:1 to 1:1000.

FIGS. 1 and 2 also show basic physical and chemical information for each of the example formulations. The kinematic viscosity at 100° C. and 40° C. were measured by ASTM D445, the high temperature high shear viscosity was measured by ASTM D4683, the total base number (TBN) was measured by ASTM D2896 and ASTM D4739, and the Noack volatility was measured by ASTM D5800. The elemental concentrations were calculated based on the components present in the formulation. Each of the remaining figures also includes physical and chemical data for example formulations obtained by these methods. In some cases, the CEC L-109-14 oxidation test can be run for a longer duration than the standard test method. Included in FIGS. 1 and 2 are data obtained by running the CEC L-109-14 oxidation test to 240 hours, as opposed to the standard 216 hour test. Elements of the disclosure are even further demonstrated when the oxidation test is run for longer duration than typically prescribed.

Surprisingly, FIG. 3 shows additional improvements in viscosity and oxidation control (as measured by the CEC L-109-14 oxidation test) when the total concentration of detergent in the formulation is limited or eliminated. Examples 8-11 show a reduction in detergent concentration leads to overall improved viscosity and oxidation control, especially when biodiesel is present (as in the CEC L-109-14 test). Moving from a full detergent concentration (Example 11) to a formulation containing no detergent shows an approximate 475% improvement in viscosity and oxidation control. Comparative Examples 14-16 further demonstrate this effect, showing that increasing the level of calcium salicylate detergent significantly hinders the viscosity and oxidation control performance of these formulations. This is surprising since the purpose of detergent additives is not only to provide cleanliness but also to serve as an alkalinity reserve to neutralize acidic byproducts of oxidation which in turn slows the rate of oxidation. FIG. 3 also includes basic physical and chemical information about the example formulations. In addition to the test methods described previously, FIG. 3 includes sulfated ash as measured by ASTM D874 and also the boron-to-nitrogen ratio (B/N). This is calculated by dividing the total boron concentration by the total nitrogen concentration in the formulation.

It is clear from FIG. 3 that reducing or eliminating sulfated ash bearing detergents contributes to improved oxidation and viscosity control; however, formulating lubricants without sufficient detergent can have significant impacts which compromise viscosity control and oxidation in other ways.

FIG. 4 shows a set of comparative results from Sequence IIIG engine testing (ASTM D7320). Comparing Comparative Example 17 in FIG. 4 with Comparative Examples 18 and 19 show significant impacts to removing detergent and antioxidant. Comparative Example 19 contains no detergent, and while the viscosity control is significantly improved compared with Comparative Example 18, the weighted piston demerits (WPD) are significantly poorer. It is clear from these examples that lubricants formulated without detergent are significantly hindered in overall performance including viscosity and oxidation control, as well as providing for engine cleanliness. It is clear then that the combination of a formulated antioxidant system, comprising an aminic and hindered phenol ester AO, used in combination with a sulfonate type over-based detergent provides significantly improved viscosity control, oxidation protection, and cleanliness performance.

FIGS. 5 and 6 show additional aspects of the disclosure, wherein it has surprisingly been found that formulations containing the previously mentioned antioxidant system, a sulfonate detergent (especially a magnesium sulfonate detergent or mixtures of calcium and magnesium sulfonate detergents), and a borated dispersant with a high boron-to-Nitrogen (B/N) ratio shows significantly improved viscosity and oxidation control as measured in the CEC L-109-14 oxidation test. Comparative Examples 24-26 show the effects of combining Mg sulfonate detergents with several different dispersants. Surprisingly, in formulations where magnesium sulfonate detergent is combined with non-borated dispersants or borated dispersants with a low B/N ratio the viscosity and oxidation control are worse as compared to formulations containing magnesium sulfonate detergent mixed with a borated dispersant with a high B/N ratio. This is especially apparent comparing Comparative Example 26 and 27 with Examples 13-15. At equivalent levels of boron (300 ppm) there is significant improvement for sulfonate detergents when a high B/N ratio borated dispersant is present and the formulation has a sufficient B/N ratio.

It is important to note that formulations containing boron and magnesium are advantageous for several reasons. Besides the observed improvements in viscosity and oxidation control, such formulations are also expected to provide improvements in reducing or preventing low speed pre-ignition when used in turbocharged direct injection gasoline engines operating at high brake mean effective pressures (>10 bar) and low engine speeds (<3000 RPM). See, for example, U.S. Patent Application Publication No. US2015/0322368 which is incorporated herein by reference.

FIGS. 5 and 6 further demonstrate the disclosure when comparing Examples 12, 14, and 15 with Comparative Examples 20-23. As shown previously, formulations containing sulfonate type detergents show significant improvement over formulations containing salicylate type detergents, even when combined with various non-borated dispersants. Examples 13 and 14 show no significant change in viscosity or oxidation control when a calcium sulfonate detergent is used in combination with a high B/N dispersant (at equivalent nitrogen levels), however Example 17 and Comparative Example 27 show significant performance improvements when a high B/N dispersant is used when magnesium sulfonate detergents, or mixtures of calcium sulfonate and magnesium sulfonate detergents are present. For the purposes of this disclosure, a low B/N ratio dispersant is defined as a borated dispersant with a boron-to-nitrogen ratio of about 0.5, a mid B/N dispersant shall be defined as a borated dispersant with a boron-to-nitrogen ratio of about 1, and a high B/N dispersant shall be defined as a borated dispersant with a boron-to-nitrogen ratio of about 2.

FIGS. 7, 8, and 9 further demonstrate the efficacy of the inventive compositions at a broad range of concentrations. Comparative Examples 31-34 show formulations comprising the antioxidant system discussed in FIGS. 1 and 2, as well as a magnesium sulfonate detergent and a low B/N dispersant. Comparing these results with Examples 18-30 as well as Comparative Examples 30 and 35 show significant improvements in viscosity control and oxidation protection (as measured in the CEC L-109-14 test). Examples 18-21 combine the AO system described in FIGS. 1 and 2 with a magnesium sulfonate detergent and mid B/N borated dispersant. These results are significantly improved over Comparative Examples 31-34 at equivalent boron concentrations ranging from 0 ppm to 1000 ppm boron. Further improvement is observed for Examples 22-30 which combine a sulfonate detergent (either Mg or Ca) with a high B/N borated dispersant.

Comparing these results with Comparative Example 29 as well as Examples 26 and 31 further demonstrate the disclosure at substantially lower detergent levels. Preferable detergent concentrations would provide about 500-5000 ppm detergent metal to the final formulation, and more preferably 500-3000 ppm, or even more preferable 500-2500 ppm. In some cases about 500-2200 ppm may be preferable or even 500-1800 ppm. In these cases the preferred detergents would be calcium sulfonate or magnesium sulfonate detergents, or mixtures thereof. The ratio of calcium sulfonate detergent to magnesium sulfonate could range from 0.1:1 to 1:1000. When such detergent metal concentrations are present, it may also be preferable to provide to the formulation boron which is derived from a mid to high B/N borated dispersant (i.e. borated dispersants with a boron-to-nitrogen (B/N) ratio of about 1 to about 2). In these cases the concentration of boron provided by the mid to high B/N borated dispersant is preferably about 10 ppm to about 1500 ppm, more preferably about 50 ppm to about 1000 ppm, or about 50 ppm to about 500 ppm. In some cases the boron concentration provided to the formulation from the mid to high B/N borated dispersant may preferably be about 100 ppm to about 500 ppm or 100 ppm to about 300 ppm boron.

In cases were the concentration of detergent metal in the formulation is higher than about 2000 ppm to about 3500 ppm or perhaps even 5000 ppm, a higher level of boron contributed from a mid B/N to high B/N borated dispersant is preferred. In such cases the boron concentration contributed from the mid to high B/N borated dispersant should be from 100 ppm to 1000 ppm, or 200 ppm to 1000 ppm, or even 300 ppm to 1000 ppm. In some cases, particularly when there is a large concentration of detergent metal, 300 ppm boron or more may be needed to achieve the desired improvement in viscosity and oxidization control.

FIG. 10 shows an additional aspect of the disclosure which is the unique synergy of the previously described combination of additives with the appropriate selected base oil. Comparative Examples 36-44 show viscosity control and oxidation protection (as measured in the CEC L-109-14 oxidation test) for formulations comprising a magnesium sulfonate detergent and a low B/N borated dispersant at a range of boron concentrations. Each of the examples are formulated with either all Group II base stock, all Group III base stock, or all Group IV base stock. Comparing these formulations with Examples 37-45 which are similar to the Comparative Examples with the exception of the use of a high B/N borated dispersant shows the improvement in viscosity control and oxidation protection when a high B/N borated dispersant is used in combination with a magnesium sulfonate detergent in any of Group II, Group III, or Group IV formulations. Surprisingly, increased efficacy of the inventive composition in Group III base oil shows additional synergy. This is most apparent in comparing Examples 40-42 with Comparative Examples 39-41 as well as Examples 23-25 in FIG. 7. Examples 23-25 in FIG. 7 contain a mixture of Group III and Group IV base oil. The improvement observed in Examples 40-42 is greater than the ratio of the Group IV to Group III base oils and shows additional benefit for the inventive composition when mixed in Group III or Group IV base oils. Mixtures of Group III and Group IV base oils also exhibit the uniquely observed improvements in oxidation and viscosity control. Comparative Examples 36-38 and Examples 37-40 are further demonstration of the efficacy of the inventive combination of additives even in lubricant compositions formulated in Group II base oils.

PCT and EP Clauses:

1. A method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising:

a lubricating oil base stock as a major component; and a mixture of (i) at least one detergent, and (ii) at least one antioxidant, as minor components; wherein the at least one detergent comprises a sulfonate detergent; wherein the at least one antioxidant comprises an alkylated diphenylamine; wherein the engine or other mechanical component is lubricated with the lubricating oil operating to in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one sulfonate detergent, and (ii) at least one alkylated diphenylamine antioxidant;

a lubricating oil base stock as a major component; and a mixture of (i) at least one detergent, and (ii) at least one antioxidant, as minor components; wherein the at least one detergent comprises a calcium-containing detergent; wherein the at least one antioxidant comprises an alkylated diphenylamine; wherein the engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium-containing detergent, and (ii) at least one alkylated diphenylamine antioxidant;

a lubricating oil base stock as a major component; and a mixture of (i) at least one detergent, and (ii) at least one antioxidant, as minor components; wherein the at least one detergent comprises a calcium sulfonate detergent; wherein the at least one antioxidant comprises an alkylated diphenylamine; wherein the engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium sulfonate detergent, and (ii) at least one alkylated diphenylamine antioxidant; or a lubricating oil base stock as a major component; and at least one detergent, as a minor component; wherein the at least one detergent comprises a calcium sulfonate detergent; wherein the engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing a minor components other than the at least one calcium sulfonate detergent.

2. The method of clause 1 wherein:

said sulfonate detergent comprises a metal sulfonate; or said calcium-containing detergent comprises calcium sulfonate.

3. The method of clauses 1 and 2 wherein said at least one antioxidant comprises a mixture of (i) an alkylated diphenylamine and (ii) a hindered phenol ester.

4. The method of clauses 1-3 wherein the lubricating oil base stock comprises a Group I, Group II, Group III, Group IV or Group V base oil.

5. The method of clauses 1-4 wherein:

the lubricating oil base stock is present in an amount of from about 6 weight percent to about 95 weight percent, the sulfonate detergent is present in an amount of from about 0.1 weight percent to about 20 weight percent, and the alkylated diphenylamine antioxidant is present in an amount of from about 0.1 weight percent to about 5 weight percent, all based on the total weight of the formulated oil;

the lubricating oil base stock is present in an amount of from about 6 weight percent to about 95 weight percent, the calcium sulfonate detergent is present in an amount of from about 0.1 weight percent to about 20 weight percent, and the alkylated diphenylamine antioxidant is present in an amount of from about 0.1 weight percent to about 5 weight percent, all based on the total weight of the formulated oil;

the lubricating oil base stock is present in an amount of from about 6 weight percent to about 95 weight percent, the calcium-containing detergent is present in an amount of from about 0.1 weight percent to about 20 weight percent, and the alkylated diphenylamine antioxidant is present in an amount of from about 0.1 weight percent to about 5 weight percent, all based on the total weight of the formulated oil; or the lubricating oil base stock is present in an amount of from about 6 weight percent to about 95 weight percent, and the calcium sulfonate detergent is present in an amount of from about 0.1 weight percent to about 20 weight percent, based on the total weight of the formulated oil.

6. The method of clauses 1-5 wherein:

the weight ratio of the sulfonate detergent to the alkylated diphenylamine antioxidant is from about 0.1:1 to about 1000:1;

the weight ratio of the calcium-containing detergent to the alkylated diphenylamine antioxidant is from about 0.1:1 to about 1000:1; or the weight ratio of the calcium sulfonate detergent to the alkylated diphenylamine antioxidant is from about 0.1:1 to about 1000:1.

7. A method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant that provides a boron concentration from about 10 to about 1500 parts per million in said formulated oil; wherein the at least one antioxidant comprises an alkylated diphenylamine; wherein the engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant.

8. The method of clause 7 wherein said at least one detergent comprises magnesium sulfonate.

9. The method of clauses 7 and 8 wherein said at least one dispersant comprises a borated succinimide.

10. The method of clauses 7-9 wherein said at least one antioxidant comprises a mixture of (i) an alkylated diphenylamine and (ii) a hindered phenol ester.

11. The method of clauses 7-10 wherein the lubricating oil base stock is present in an amount of from about 6 weight percent to about 95 weight percent, the at least one detergent is present in an amount of from about 0.1 weight percent to about 20 weight percent, the at least one dispersant is present in an amount of from about 0.1 weight percent to about 20 weight percent, and the at least one antioxidant is present in an amount of from about 0.1 weight percent to about 5 weight percent, all based on the total weight of the formulated oil.

12. The method of clauses 7-11 wherein the weight ratio of the at least one detergent to the at least one antioxidant is from about 0.1:1 to about 1000:1, and wherein the weight ratio of the at least one dispersant to the at least one antioxidant is from about 0.1:1 to about 1000:1.

13. The method of clauses 1-12 wherein the lubricating oil base stock comprises a Group I, Group II, Group III, Group IV or Group V base oil.

14. A lubricating oil having a composition comprising:

a lubricating oil base stock as a major component; and a mixture of (i) at least one detergent, and (ii) at least one antioxidant, as minor components; wherein the at least one detergent comprises a sulfonate detergent; wherein the at least one antioxidant comprises an alkylated diphenylamine; wherein an engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one sulfonate detergent, and (ii) at least one alkylated diphenylamine antioxidant;

a lubricating oil base stock as a major component; and a mixture of (i) at least one detergent, and (ii) at least one antioxidant, as minor components; wherein the at least one detergent comprises a calcium-containing detergent; wherein the at least one antioxidant comprises an alkylated diphenylamine; wherein an engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium-containing detergent, and (ii) at least one alkylated diphenylamine antioxidant;

a lubricating oil base stock as a major component; and a mixture of (i) at least one detergent, and (ii) at least one antioxidant, as minor components; wherein the at least one detergent comprises a calcium sulfonate detergent; wherein the at least one antioxidant comprises an alkylated diphenylamine; wherein an engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one calcium sulfonate detergent, and (ii) at least one alkylated diphenylamine antioxidant; or a lubricating oil base stock as a major component; and at least one detergent, as a minor component; wherein the at least one detergent comprises a calcium sulfonate detergent; wherein an engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing a minor component other than the at least one calcium sulfonate detergent.

15. A lubricating oil having a composition comprising a lubricating oil base stock as a major component; and a mixture of (i) at least one detergent, (ii) at least one dispersant, and (iii) at least one antioxidant, as minor components; wherein the at least one detergent comprises a magnesium-containing detergent; wherein the at least one dispersant comprises a borated dispersant that provides a boron concentration from about 10 to about 1500 parts per million in said formulated oil; wherein the at least one antioxidant comprises an alkylated diphenylamine; wherein the engine or other mechanical component is lubricated with the lubricating oil operating in the presence of biodiesel fuel; and wherein oxidation stability and viscosity control are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for improving oxidation stability and viscosity control, while maintaining or improving cleanliness performance and deposit control, in an engine or other mechanical component lubricated with a lubricating oil by using as the lubricating oil a formulated oil, said formulated oil having a composition comprising a lubricating oil base stock at from about 81.0 wt. % to 93.1 wt. % of the lubricating oil comprising a blend of a Group III base stock, a Group IV base stock and about 5 wt % of a Group V base stock; and a mixture of (i) at least one detergent, (ii) at least one dispersant, and (iii) at least one antioxidant, as minor components; wherein the at least one detergent comprises a magnesium sulfonate detergent at from about 0.6 to 2.0 wt. % of the lubricating oil; wherein the at least one dispersant comprises a borated dispersant at from about 0.4 to 7.7 wt. % of the lubricating oil and selected from the group consisting of a boron-containing polyisobutenyl succinimide/succinic acid with a Boron to Nitrogen (B/N) of about 1.0, a boron-containing polyisobutenyl succinimide/succinic acid with a B/N of about 2.0, and combinations thereof; that provides a boron concentration from about 100 to about 1000 parts per million in said formulated oil; wherein the at least one antioxidant comprises an alkylated diphenylamine at from about 0.8 to 1.5 wt. % of the lubricating oil; wherein the engine or other mechanical component is lubricated with the lubricating oil operating in the presence of biodiesel fuel; and wherein oxidation stability as measured by the CEC L-109-14 FTIR oxidation at 216 hours and viscosity control as measured by the CEC L-109-14 Relative KV100 increase at 100 deg. C. for 216 hours are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant.

2. The method of claim 1 wherein said at least one antioxidant comprises a mixture of (i) an alkylated diphenylamine and (ii) a hindered phenol ester.

3. The method of claim 1 wherein the formulated oil further comprises one or more of an antiwear additive, viscosity modifier, other antioxidant, other detergent, other dispersant, pour point depressant, corrosion inhibitor, metal deactivator, seal compatibility additive, anti-foam agent, inhibitor, and anti-rust additive.

4. The method of claim 1 wherein the formulated oil is a passenger vehicle engine oil (PVEO) or a commercial vehicle engine oil (CVEO).

5. A lubricating oil having a composition comprising a lubricating oil base stock at from about 81.0 wt. % to 93.1 wt. % of the lubricating oil comprising a blend of a Group III base stock, a Group IV base stock and about 5 wt % of a Group V base stock; and a mixture of (i) at least one detergent, (ii) at least one dispersant, and (iii) at least one antioxidant, as minor components; wherein the at least one detergent comprises a magnesium sulfonate detergent at from about 0.6 to 2.0 wt. % of the lubricating oil; wherein the at least one dispersant comprises a borated dispersant at from about 0.4 to 7.7 wt. % of the lubricating oil and selected from the group consisting of a boron-containing polyisobutenyl succinimide/succinic acid with a Boron to Nitrogen (B/N) of about 1.0, a boron-containing polyisobutenyl succinimide/succinic acid with a B/N of about 2.0, and combinations thereof; that provides a boron concentration from about 100 to about 1000 parts per million in said lubricating oil; wherein the at least one antioxidant comprises an alkylated diphenylamine at from about 0.8 to 1.5 wt. % of the lubricating oil; wherein the engine or other mechanical component is lubricated with the lubricating oil operating in the presence of biodiesel fuel; and wherein oxidation stability as measured by the CEC L-109-14 FTIR oxidation at 216 hours and viscosity control as measured by the CEC L-109-14 Relative KV100 increase at 100 deg. C. for 216 hours are improved and cleanliness performance and deposit control are maintained or improved as compared to oxidation stability, viscosity control, cleanliness performance and deposit control achieved using a lubricating oil containing minor components other than the mixture of (i) at least one magnesium-containing detergent, (ii) at least one borated dispersant, and (iii) at least one alkylated diphenylamine antioxidant.

6. The lubricating oil of claim 5 wherein said at least one antioxidant comprises a mixture of (i) an alkylated diphenylamine and (ii) a hindered phenol ester.

7. The lubricating oil of claim 5 wherein the formulated oil further comprises one or more of an antiwear additive, viscosity modifier, other antioxidant, other detergent, other dispersant, pour point depressant, corrosion inhibitor, metal deactivator, seal compatibility additive, anti-foam agent, inhibitor, and anti-rust additive.

8. The lubricating oil of claim 5 which is a passenger vehicle engine oil (PVEO) or a commercial vehicle engine oil (CVEO).

* * * * *